US008651832B2

(12) United States Patent
Ito

(10) Patent No.: US 8,651,832 B2
(45) Date of Patent: Feb. 18, 2014

(54) ELECTRIC FUEL PUMP WITH DICHARGE-SIDE COVER THAT IS ISOLATED FROM THE FUEL PASSAGE

(75) Inventor: Motoya Ito, Hekinan (JP)

(73) Assignee: Denso Corporation, Kariya (JP)

( * ) Notice: Subject to any disclaimer, the term of this patent is extended or adjusted under 35 U.S.C. 154(b) by 1208 days.

(21) Appl. No.: 12/362,676

(22) Filed: Jan. 30, 2009

(65) Prior Publication Data

US 2009/0202368 A1 Aug. 13, 2009

(30) Foreign Application Priority Data

Feb. 7, 2008 (JP) ..... 2008-28041
Dec. 16, 2008 (JP) ..... 2008-320083

(51) Int. Cl.
*F04B 35/04* (2006.01)

(52) U.S. Cl.
USPC ..... 417/410.1; 417/423.14

(58) Field of Classification Search
USPC ..... 417/410.1, 423.14
See application file for complete search history.

(56) References Cited

U.S. PATENT DOCUMENTS 5,520,547 A * 5/1996 Hamaoka et al. ..... 439/206
5,593,287 A * 1/1997 Sadakata et al. ..... 417/366
5,697,769 A * 12/1997 Kobman et al. ..... 417/410.1
6,478,613 B1 * 11/2002 Zoell et al. ..... 439/519
7,195,466 B2 * 3/2007 Kobayashi et al. ..... 417/423.7
2001/0022172 A1 * 9/2001 Moroto et al. ..... 123/497
2003/0202893 A1 * 10/2003 Moroto et al. ..... 417/423.7
2004/0150280 A1 * 8/2004 Moroto et al. ..... 310/154.28
2005/0151441 A1 * 7/2005 Ito et al. ..... 310/234
2005/0163636 A1 * 7/2005 Becker et al. ..... 417/423.3
2006/0204385 A1 * 9/2006 Ikeya ..... 417/423.8
2008/0063545 A1 * 3/2008 Takagi et al. ..... 417/410.1
2008/0063546 A1 * 3/2008 Itoh et al. ..... 417/423.7
2008/0069710 A1 * 3/2008 Kiyose et al. ..... 417/423.1
2009/0102314 A1 * 4/2009 Miyata et al. ..... 310/257
2009/0123307 A1 * 5/2009 Silva et al. ..... 417/410.1
2009/0202368 A1 * 8/2009 Ito ..... 417/410.1
2009/0297364 A1 * 12/2009 Takagi et al. ..... 417/48
2010/0287771 A1 * 11/2010 Takagi et al. ..... 29/888.02
2012/0051954 A1 * 3/2012 Asai et al. ..... 417/410.1

FOREIGN PATENT DOCUMENTS

JP 2001-323856 11/2001
JP 2002-544425 12/2002
JP 2008-005689 1/2008
JP 2008-64027 3/2008
JP 2008-64029 3/2008

* cited by examiner

*Primary Examiner* — Nimeshkumar Patel
*Assistant Examiner* — Jacob R Stern
(74) *Attorney, Agent, or Firm* — Nixon & Vanderhye P.C.

(57) ABSTRACT

In a fuel pump, a case member and a discharge-side cover define a fuel passage. A holder is held between the case member and the discharge-side cover. Brush terminals are supported by the holder to conduct electricity between power receiving terminals and brushes. The power receiving terminals have connector portions that are connected with the brush terminals. A wall of the discharge-side cover and a wall of the holder clamp the connector portions therebetween. The wall of the discharge-side cover and the wall of the holder partition an installation space, which is isolated from the fuel passage and in which the connector portions are enclosed.

21 Claims, 16 Drawing Sheets

ELECTRIC FUEL PUMP WITH DICHARGE-SIDE COVER THAT IS ISOLATED FROM THE FUEL PASSAGE

CROSS REFERENCE TO RELATED APPLICATION

This application is based on and incorporates herein by reference Japanese Patent Applications No. 2008-028041 filed on Feb. 7, 2008 and No. 2008-320083 filed on Dec. 16, 2008.

BACKGROUND OF THE INVENTION

1. Field of the Invention

The present invention relates to an electric fuel pump that pumps fuel.

2. Description of Related Art

Conventionally, a fuel pump that has a pump portion and a motor portion, which are placed in a case member, is known (see JPH07-091343A corresponding to U.S. Pat. No. 5,520,547, and JP2002-544425T corresponding to U.S. Pat. No. 6,478,613). FIG. 19 shows an entire construction of the fuel pump disclosed in JPH07-091343A corresponding to U.S. Pat. No. 5,520,547. As shown in FIG. 19, a discharge-side cover 1010 and case members 1020, 1030 define fuel passages 1013, 1042 therein. A fuel discharge port 1011 is formed in the discharge-side cover 1010. A fuel suction port 1031 is formed in the case member 1030. A holder 1040 is placed in the discharge-side cover 1010. The holder 1040 holds a positive brush and a negative brush that are placed inside the discharge-side cover 1010. The positive and negative brushes are in contact with a commutator of a motor portion 1050 to supply electric power from a positive terminal and a negative terminal 1012 to the motor portion 1050.

The motor portion 1050 includes an armature 1051. A pump portion 1060 includes an impeller 1061. The pump portion 1060 is driven by the motor portion 1050 to suck fuel from the fuel suction port 1031 and to pump the fuel to the fuel discharge port 1011.

FIG. 20 is an exploded cross-sectional view showing the discharge-side cover 1010 and the holder 1040, which are shown in FIG. 19. As shown in FIG. 20, the positive and negative terminals 1012 are fixed to the holder 1040. The electric power for driving the motor portion 1050 is supplied from an external electric power source to the positive and negative terminals 1012.

Arrows L1-L4 in FIG. 19 indicate fuel flow. When the pump portion 1060 drives, fuel is sucked into the fuel suction port 1031 (see the arrow L1). Then, the fuel flows through the fuel passage 1042 in the case member 1020 (see the arrow L2) and through the fuel passage 1013 in the discharge-side cover 1010 (see the arrow L3). Finally, the fuel is discharged out of the fuel discharge port 1011 (see the arrow L4).

The fuel pump disclosed in JPH07-091343A corresponding to U.S. Pat. No. 5,520,547 is a pump for gasoline fuel. However, in recent years, demand for alternative fuels that substitute for gasoline is increasing. The alternative fuels are concentrated alcohol fuel, bioethanol, 100% ethanol fuel, etc. These alternative fuels contain electrically conductive ingredients. Therefore, if a conventional pump for gasoline fuel is used as a fuel pump for pumping alternative fuels as it is, the following problem occurs.

In the fuel pump disclosed in JPH07-091343A corresponding to U.S. Pat. No. 5,520,547, the positive and negative terminals 1012 are fixed to a top surface of the holder 1040. The positive and negative terminals 1012 are exposed to a space in the fuel passage 1013. That is, whole bodies of the positive and negative terminals 1012 are exposed to the fuel (see the arrow L3 in FIG. 19). If the fuel contains the electrically conductive ingredients as mentioned above, electric current (hereafter referred to as leakage current) passes between the positive and negative terminals 1012. Thereby, the positive and negative terminals 1012 are subject to electrochemical corrosion (hereafter referred to just as electric corrosion) in areas exposed to the fuel. This causes poor electrical continuity at the positive and negative terminals 1012 and/or breakage of the positive and negative terminals 1012.

SUMMARY OF THE INVENTION

The present invention is made in view of the above-mentioned problem. Thus, it is an objective of the present invention to provide a fuel pump that can inhibit electric corrosion of terminal parts even if fuel contains electrically conductive ingredients.

To achieve the objective of the present invention, there is provided a fuel pump that has a case member, a discharge-side cover, a holder, a pump portion, a motor portion, a positive terminal, a negative terminal, a positive brush, a negative brush, a positive brush terminal and a negative brush terminal. The case member has a fuel suction port. The discharge-side cover has a fuel discharge port and is connected with the case member. The case member and the discharge-side cover define a fuel passage therein to communicate between the fuel suction port and the fuel discharge port. The holder is held between the case member and the discharge-side cover. The pump portion is placed in the fuel passage to pump fuel from the fuel suction port to the fuel discharge port. The motor portion is placed in the case member. The motor portion has an armature, which drives the pump portion, and a commutator, which rectifies electricity supplied to the armature. The positive terminal and the negative terminal extend from an inside of the discharge-side cover to an outside of the discharge-side cover to receive the electricity from an external electric power source. The positive brush and the negative brush are supported by the holder to slide on the commutator to conduct the electricity between the positive and negative terminals and the commutator. The positive brush terminal is supported by the holder and is placed between the positive terminal and the positive brush to conduct the electricity between the positive terminal and the positive brush. The negative brush terminal is supported by the holder and is placed between the negative terminal and the negative brush to conduct the electricity between the negative terminal and the negative brush. The positive terminal has a positive connector portion that is connected with the positive brush terminal. The negative terminal has a negative connector portion that is connected with the negative brush terminal. A wall of the discharge-side cover and a wall of the holder clamp at least one of the positive and negative connector portions therebetween to partition an installation space, which is isolated from the fuel passage and in which the at least one of the positive and negative connector portions is enclosed.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF PREFERRED EMBODIMENTS

Fuel pumps according to Embodiments of the present invention will be described hereafter with reference to the accompanying drawings.

(First Embodiment)

A fuel pump according to a first embodiment of the present invention will be described with reference to FIGS. 1-15D. The fuel pump 10 is an in-tank type pump that is placed in a fuel tank of a vehicle. The fuel pump 10 supplies fuel in the fuel tank to an engine. The fuel is concentrated alcohol fuel, bioethanol, 100% ethanol fuel, etc., and contains electrically conductive ingredients.

Figure 1:
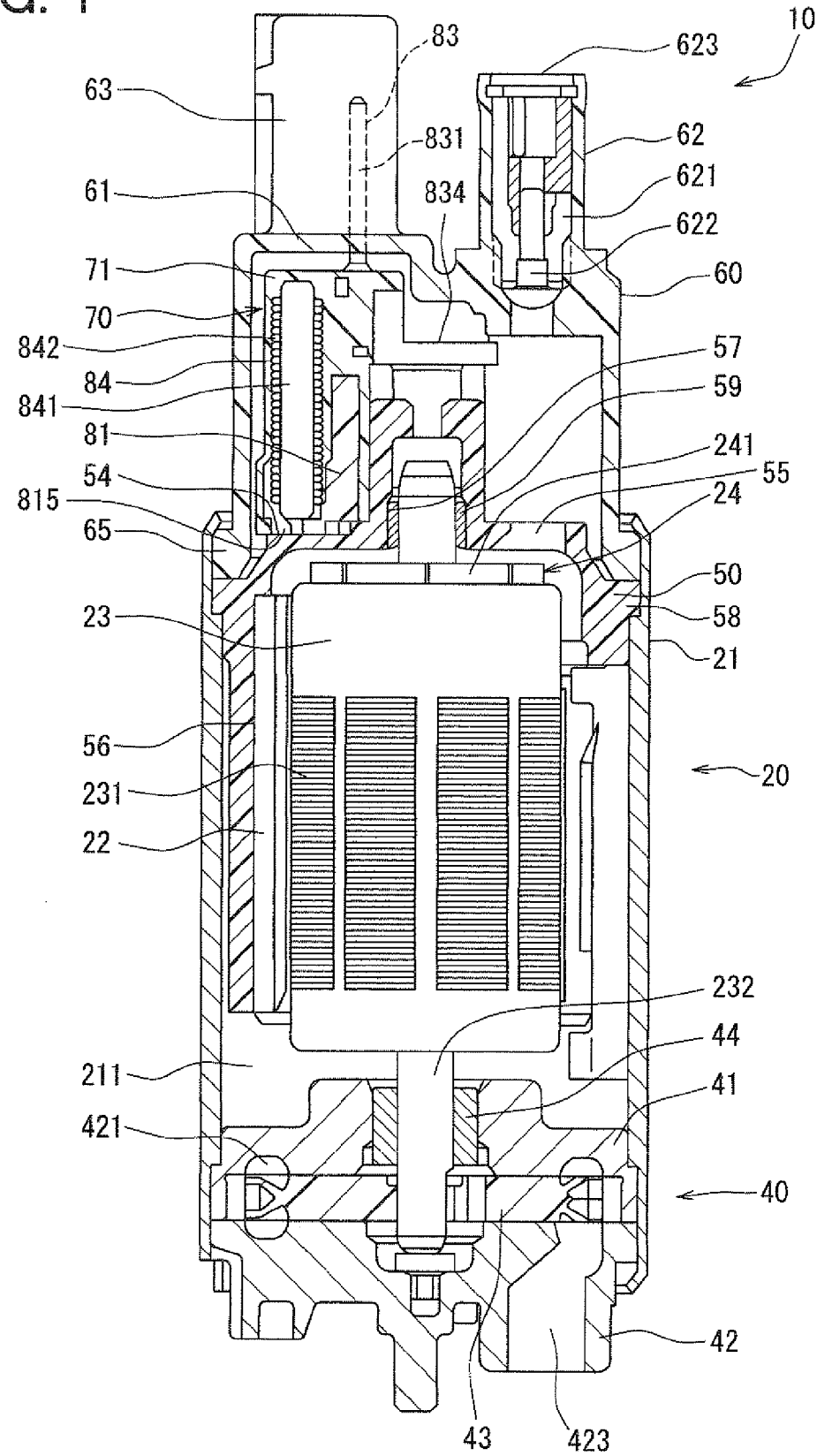
FIG. 1 is a cross-sectional view showing a fuel pump according to a first embodiment of the present invention.

Firstly, an entire construction of the fuel pump 10 will be described. FIG. 1 is a cross-sectional view showing the entire construction of the fuel pump 10. The fuel pump 10 includes a motor portion 20 and a pump portion 40. The pump portion 40 is driven by the motor portion 20, and sucks and pressurizes the fuel.

The motor portion 20 includes a brushed direct-current motor. The fuel pump 10 has a housing 21 that has an approximately cylindrical shape. Permanent magnets 22 are placed annularly one after another along a circumference of an inner wall surface of the housing 21. An armature 23 is installed radially inward of inner circumferences of the permanent magnets 22. The armature 23 is arranged coaxially with the permanent magnets 22 that are placed annularly. The armature 23 is rotatably accommodated in an interior space of the housing 21.

The armature 23 includes a core 231 and coils (not shown). The coils are wound around salient poles of the core 231. A commutator 24 is placed on one axial end side of the armature 23, which is opposite from the pump portion 40. The commutator 24 has a disk-like shape. The commutator 24 includes two or more segments 241 that are arranged side by side along a circumference of the armature 23. The segments 241 are made of carbon, for example. Gaps and dielectric resin material electrically insulate the segments 241 from each other.

Figure 2A:
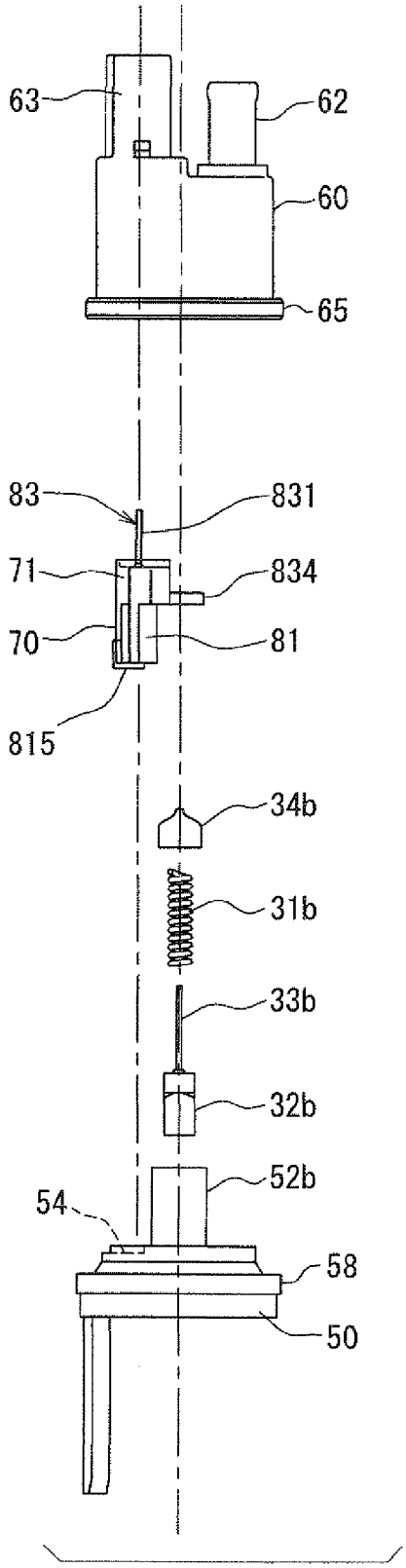
FIGS. 2A, 2B are an exploded side view and an exploded front views respectively, of a bearing holder, a discharge-side cover, a molded body and other parts arranged in the discharge-side cover of the fuel pump according to the first embodiment.
Figure 2B:
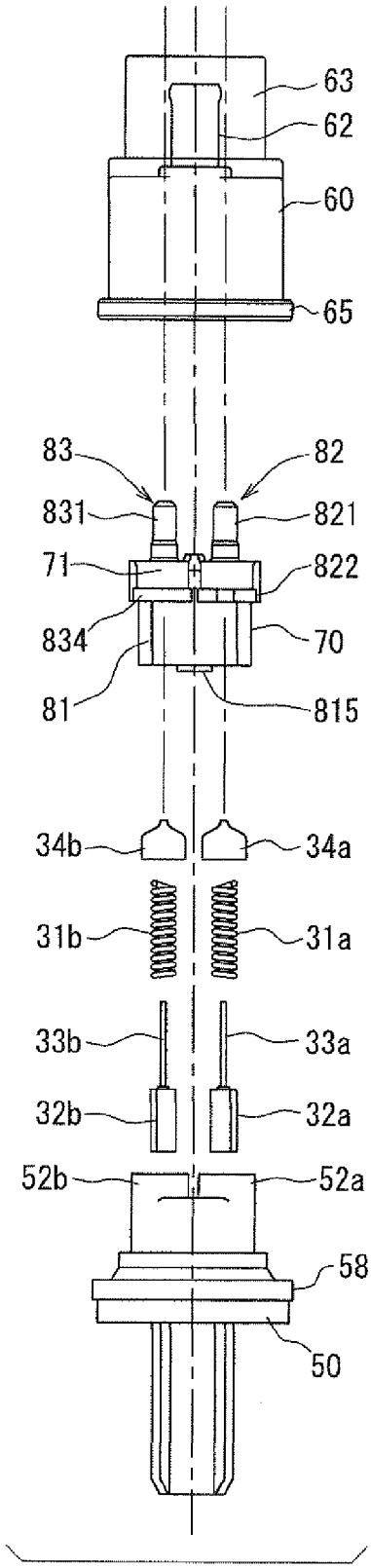

The commutator 24 contacts with a positive brush 32*a* and a negative brush 32*b* (see FIGS. 2A, 2B). The positive and negative brushes 32*a*, 32*b* are urged against the commutator 24 by brush springs 31*a*, 31*b*, respectively. The brush spring 31*a* and the positive brush 32*a* are on a positive electrode side, and the brush spring 31*b* and the negative brush 32*b* are on a negative electrode side. In FIG. 1, the brush springs 31*a*, 31*b* and the positive and negative brushes 32*a*, 32*b* are not shown.

The pump portion 40 includes a casing 41, a pump cover 42 and an impeller 43. The impeller 43 is arranged between the casing 41 and the pump cover 42. The casing 41 and the pump cover 42 define an approximately C-shaped pump duct 421. The impeller 43 is rotatably accommodated between the casing 41 and the pump cover 42.

The casing 41 is press-fitted to one axial end portion of the housing 21. A bearing 44 is installed in a central portion of the casing 41 The pump cover 42 is laid over the casing 41, and is fixed to one axial end of the housing 21 by swaging, etc.

One end portion of a shaft 232 of the armature 23 is rotatably supported by the bearing 44 in its radial direction. The other end portion of the shaft 232 is rotatably supported by another bearing 59 in the radial direction.

The pump cover 42 has a fuel suction port 423 for sucking the fuel thereinto. The impeller 43 has impeller grooves in its peripheral portion. The impeller grooves are exposed to the pump duct 421. When the impeller 43 rotates, the fuel reserved in a fuel tank (not shown) is sucked through the fuel suction port 423 into the pump duct 421. The fuel sucked into the pump duct 421 is pressurized by rotation of the impeller 43, and is discharged into a space 211 in the motor portion 20.

A bearing holder 50 and a discharge-side cover 60 are placed in the other axial end portion of the housing 21, which is opposite from the casing 41 and the pump cover 42. The bearing holder 50 corresponds to a holder in the appended claims.

The bearing holder 50 is held between the discharge-side cover 60 and the housing 21. The discharge-side cover 60 is fixed to the housing 21 by swaging. The housing 21 and the pump cover 42 in the present embodiment correspond to a case member in the appended claims.

The discharge-side cover 60 has a fuel discharge portion 62. The fuel discharge portion 62 has a check valve 622 that opens or closes a fuel passage 621. When pressure of the fuel in an inside of the fuel pump 10 exceeds a predetermined value, the check valve 622 opens the fuel passage 621. The fuel pressurized by the pump portion 40 is supplied from a fuel discharge port 623 of the fuel discharge portion 62 to an outside of the fuel pump 10 through a piping (not shown) that is connected with the fuel discharge port 623.

FIG. 2A is an exploded side view showing the bearing holder 50, the discharge-side cover 60, and other parts arranged in the discharge-side cover 60. FIG. 2B is an exploded front view showing the bearing holder 50, the discharge-side cover 60, and the other parts arranged in the discharge-side cover 60.

As shown in FIGS. 2A, 2B, a molded body 70, which will be described hereafter, is interposed between the bearing holder 50 and the discharge-side cover 60. The positive and negative brushes 32*a*, 32*b* are supported by the bearing holder 50 in such a manner that the positive and negative brushes 32*a*, 32*b* are axially slidable.

One ends of connecting wires 33*a*, 33*b* are fixed to top surfaces of the positive and negative brushes 32*a*, 32*b*, respectively The other ends of the connecting wires 33*a*, 33*b*, which are opposite from the positive and negative brushes 32*a*, 32*b*, are connected with a positive brush terminal 34*a* and a negative brush terminal 34*b*, respectively. The positive and negative brush terminals 34*a*, 34*b* are press-fitted to the bearing holder 50. The brush springs 31*a*, 31*b* push the top surfaces of the positive and negative brushes 32*a*, 32*b* to urge the positive and negative brushes 32*a*, 32*b* downward. Upper ends of the brush springs 31*a*, 31*b* contact with the positive and negative brush terminals 34*a*, 34*b*, respectively.

Figure 4:
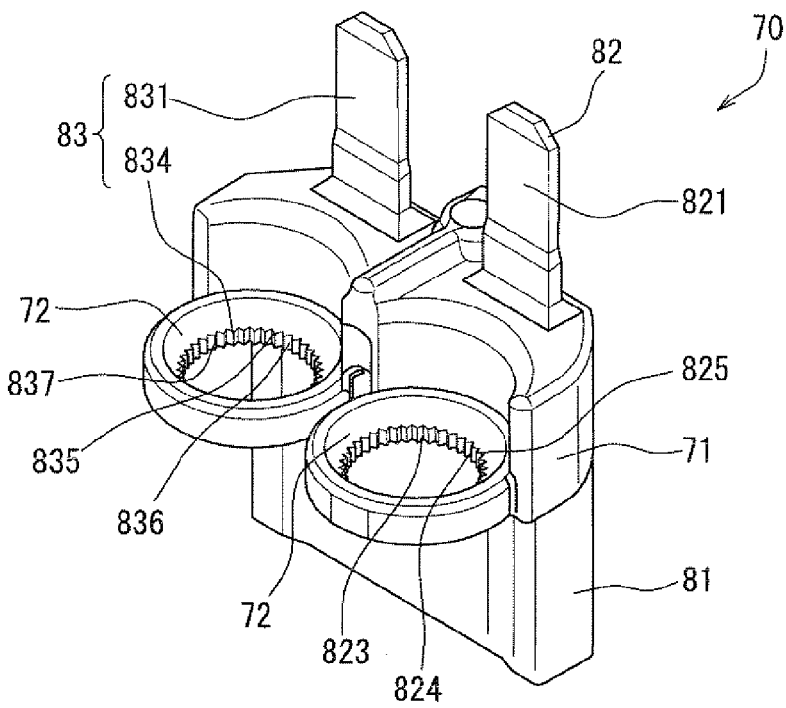
FIG. 4 is a perspective view showing the molded body of the fuel pump according to the first embodiment.
Figure 5A:
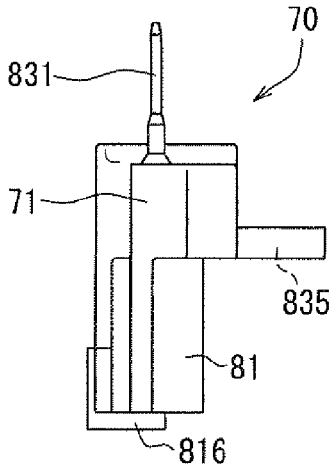
FIGS. 5A-5C are a side view, a front view and a top view, respectively, of the molded body of the fuel pump according to the first embodiment.
Figure 5B:
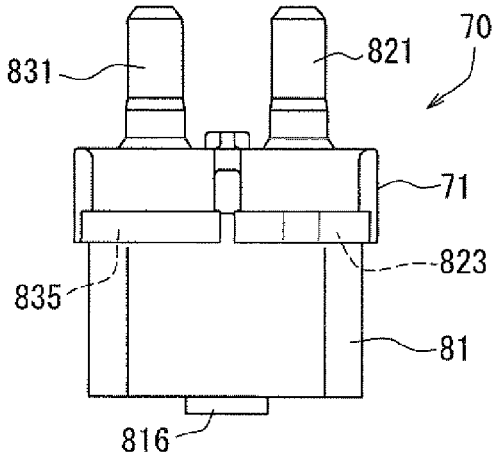
Figure 5C:
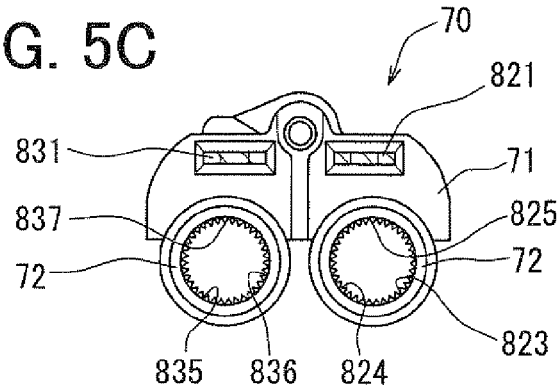
Figure 6:
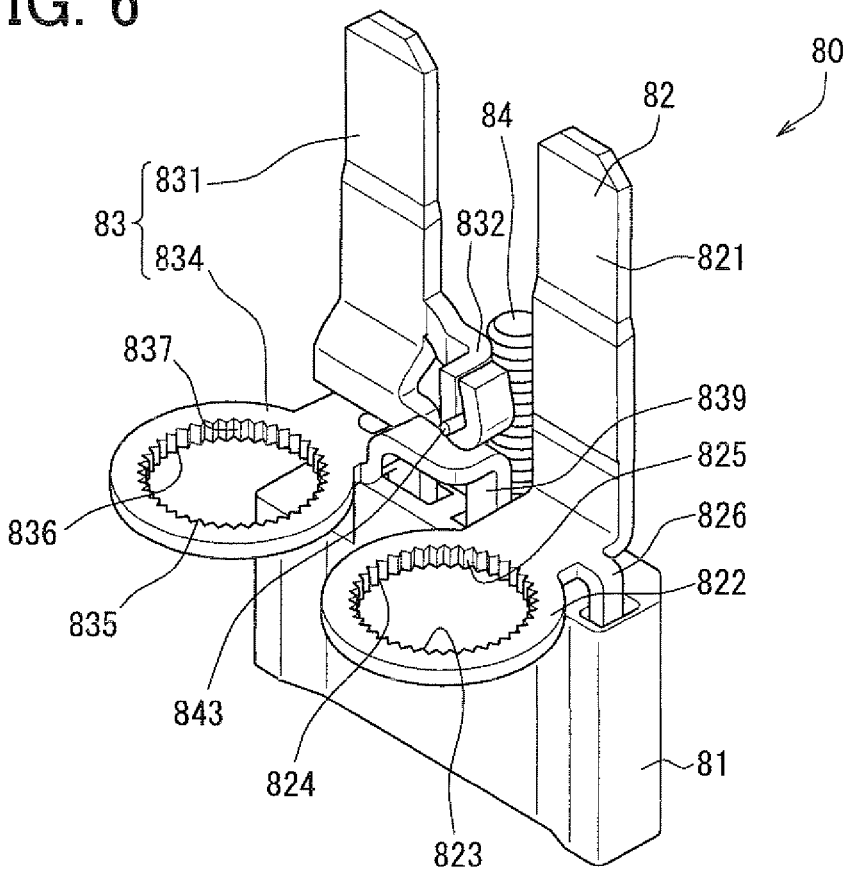
FIG. 6 is a perspective view showing an assembled body that is embedded in the molded body of the fuel pump according to the first embodiment.
Figure 7A:
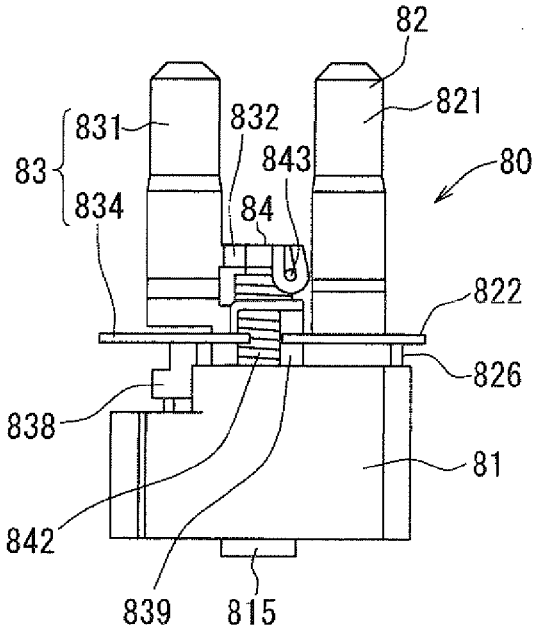
FIGS. 7A, 7B are a front view and a side view, respectively, of the assembled body shown in FIG. 6.
Figure 7B:
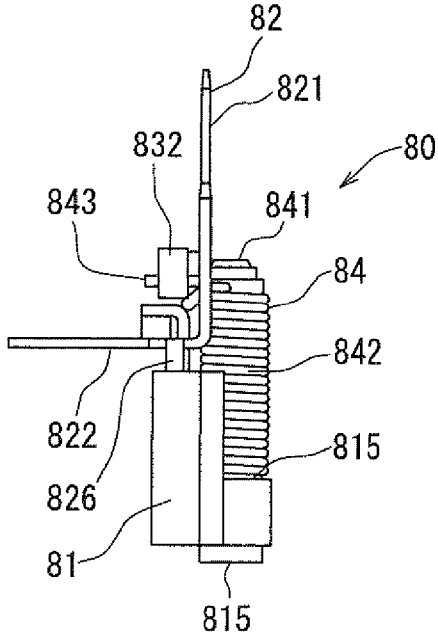

Next, a construction of the molded body 70 of the fuel pump 10 according to the present embodiment will be described below with reference to FIGS. 4-11B. FIG. 4 is a perspective view showing the molded body 70. FIGS. 5A-5C are a side view, a front view and a top view, respectively, of the molded body 70. FIG. 6 is a perspective view showing an assembled body 80 that is embedded in a molded resin portion 71 of the molded body 70. FIGS. 7A, 7B are a front view and a side view, respectively, of the assembled body 80. The molded body 70 is fabricated into a shape shown in FIGS. 4A-5C by molding the molded resin portion 71 to embed the assembled body 80, which is shown in FIGS. 6-7B, in the molded resin portion 71.

Figure 8:
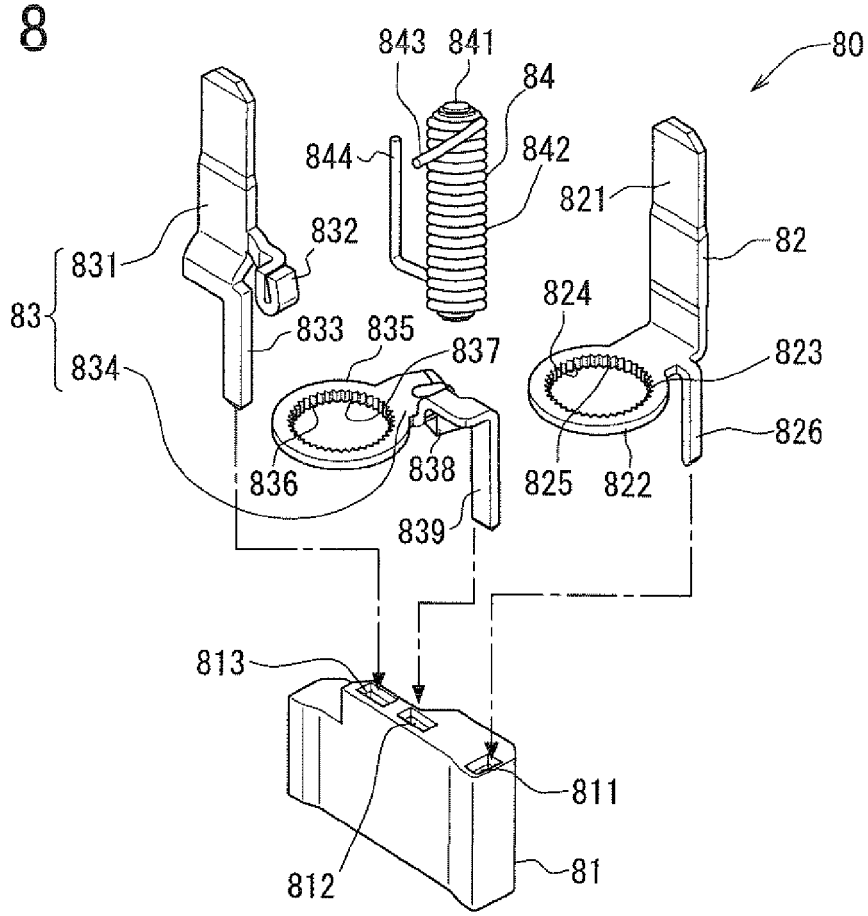
FIG. 8 is an exploded perspective view showing parts in the assembled body shown in FIGS. 6, 7A, 7B.
Figure 9:
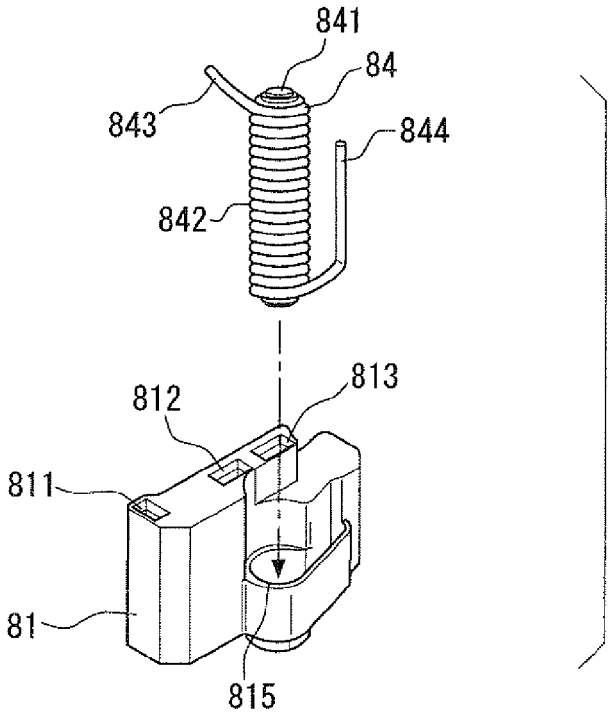
FIG. 9 is an exploded perspective view showing a body and a choke coil in the assembled body shown in FIGS. 6, 7A, 7B.

Firstly, a construction of the assembled body 80 will be described hereafter with reference to FIGS. 6-9. FIGS. 8, 9 are exploded perspective views showing the assembled body 80 that is shown in FIGS. 6-7B. FIG. 8 shows the assembled body 80 seen from its front side. FIG. 9 shows the assembled body 80 seen from its rear side. As shown in FIG. 8, the assembled body 80 has a construction in which a positive terminal 82, a negative terminal 83 and a choke coil 84 are attached to a dielectric body 81. The positive and negative terminals 82, 83 are for receiving electric power supplied from an external electric power source. FIG. 9 shows only the dielectric body 81 and the choke coil 84.

The positive terminal 82 is fabricated from flat conductive material. The positive terminal 82 has a power receiving portion 821, a relay terminal portion 822 and an anchor 826. The power receiving portion 821 is connected with the external electric power source. The relay terminal portion 822 is connected with the positive brush terminal 34*a*. The positive terminal 82 is attached to the dielectric body 81 at the anchor 826. The positive terminal 82 is bent into an approximate L-shape at a point between the power receiving portion 821 and the relay terminal portion 822. As shown in FIG. 8, the anchor 826 extends downward from a bent portion at which the positive terminal 82 is bent.

The relay terminal portion 822 has a hole portion 823. The positive brush terminal 34*a* is press-fitted into the hole portion 823 (see FIGS. 2A-3). An inner circumferential wall 824 of the hole portion 823 has protrusions 825 that protrude radially inward in the hole portion 823. Thereby, press-fitting force for press-fitting the positive brush terminal 34*a* into the hole portion 823 is decreased. The relay terminal portion 822 corresponds to a positive connector portion in the appended claims.

The negative terminal 83 has a power receiving portion 831 and a relay terminal portion 834. The power receiving portion 831 is connected with the external power source. The relay terminal portion 834 is connected with the negative brush terminal 34*b*. The power receiving portion 831 is formed separately from the relay terminal portion 834. The power receiving portion 831 and the relay terminal portion 834 are fabricated from flat conductive material. The choke coil 84 is electrically connected between the power receiving portion 831 and the relay terminal portion 834. The power receiving portion 831 has an anchor 833 at its one end opposite from power receiving end to which electric power is supplied from the external electric power source. The power receiving portion 831 is attached to the dielectric body 81 at the anchor 833. The relay terminal portion 834 is bent into an approximate L-shape. The relay terminal portion 834 has a hole portion 835 at its one end, and an anchor 839 at its another end. The relay terminal portion 834 is attached to the dielectric body 81 at the anchor 839.

Figure 3:
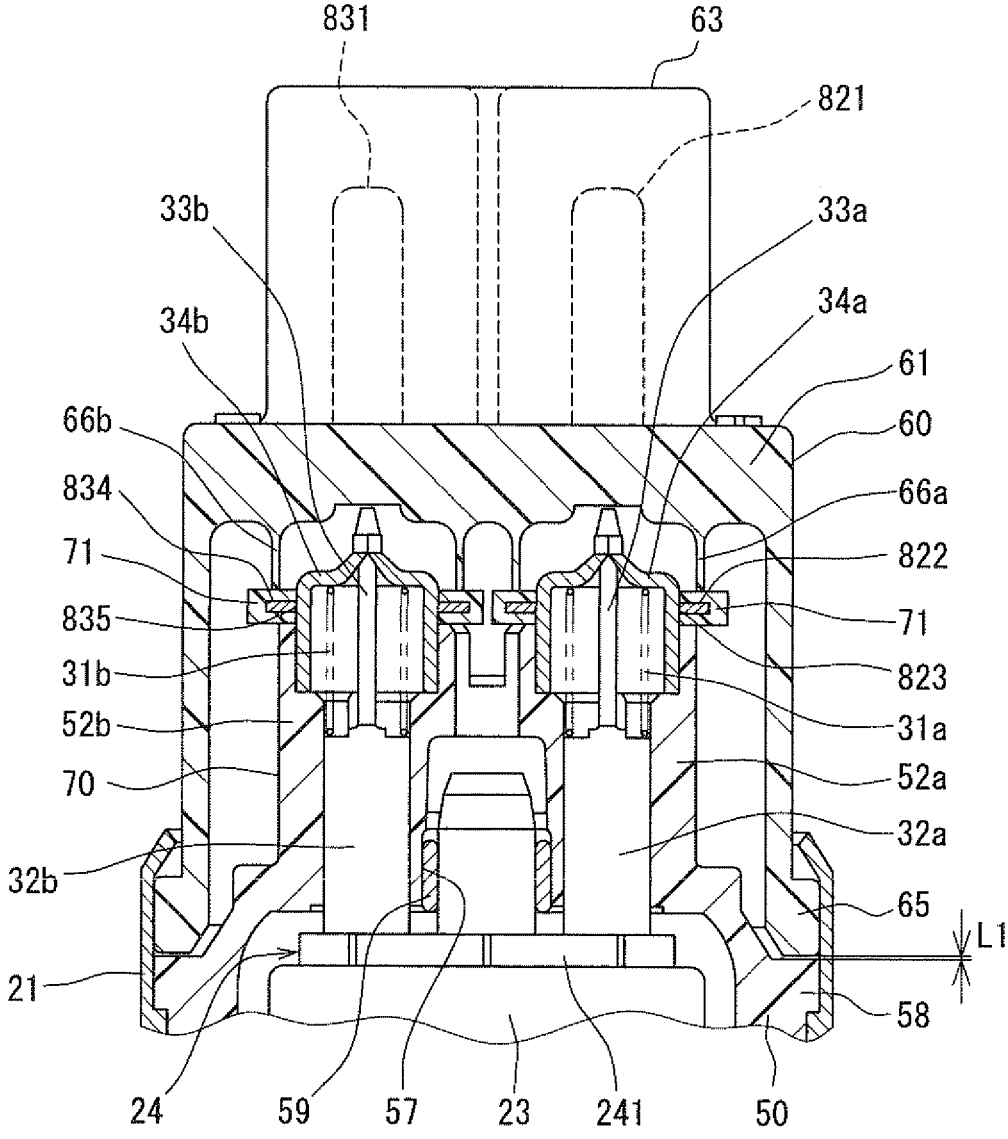
FIG. 3 is a cross-sectional view showing an arrangement of the bearing holder, the discharge-side cover, the molded body and other parts arranged in the discharge-side cover of the fuel pump according to the first embodiment.

The negative brush terminal 34*b* is press-fitted into the hole portion 835 of the relay terminal portion 834 (see FIGS. 2A-3). An inner circumferential wall 836 of the hole portion 835 has protrusions 837 that protrude radially inward in the hole portion 835 Thereby, press-fitting force for press-fitting the negative brush terminal 34*b* into the hole portion 835 is decreased. The relay terminal portion 834 corresponds to a negative connector portion in the appended claims.

The choke coil 84 is for reducing electric noise (high frequency component, for example) that is generated when the positive and negative brushes 32*a*, 32*b* successively slide on the segments 241 of the commutator 24. The choke coil 84 is formed by winding a winding wire 842 around a cylindrical choke coil core 841. One end 843 of the winding wire 842 is connected with the power receiving portion 831, and the other end 844 of the winding wire 842 is connected with the relay terminal portion 834.

As shown in FIGS. 8, 9, the dielectric body 81 is fabricated from POM (polyoxymethylene, poly acetal) resin, for example, in an approximately rectangular parallelepiped shape. The dielectric body 81 has three insertion holes 811, 812, 813 that extend downward from its top surface The anchor 826 of the positive terminal 82, the anchor 839 of the relay terminal portion 834 of the negative terminal 83, and the anchor 833 of the power receiving portion 831 of the negative terminal 83 are press-fitted into the insertion holes 811, 812, 813, respectively. As shown in FIGS. 6-7B, the positive terminal 82 and the negative terminal 83 are fitted to the dielectric body 81 in such a manner that the power receiving portions 821, 831 extend upward from the top surface of the dielectric body 81 and that the relay terminal portions 822, 834 extend frontward from the dielectric body 81.

As shown in FIG. 9, a choke coil holder 815 is formed on a rear side of the dielectric body 81. The choke coil 84 is inserted in the choke coil holder 815. The choke coil 84 is supported by the dielectric body 81 in such a manner that the choke coil 84 extends in a direction approximately in parallel with the power receiving portions 821, 831. As shown in FIGS. 6-8, the one end 843 of the choke coil 84 is connected with a connecting portion 832 of the power receiving portion 831 by heat swaging or fusing, and the other end 844 of the choke coil 84 is connected with a connecting portion 838 of the relay terminal portion 834 by heat swaging or fusing.

As shown in FIGS. 2A, 2B, 9, the power receiving portions 821, 831, the choke coil 84 and the positive and negative brushes 32*a*, 32*b* respectively have rodlike shapes, and are arranged in parallel with each other. Therefore, these parts can be systematically accommodated in a limited space in the discharge-side cover 60.

Next, a construction of the molded body 70 will be described hereafter with reference to FIGS. 4, 5A-5C, 10A, 10B, 11A, 11B. The molded body 70 is fabricated by molding the molded resin portion 71 to embed the assembled body 80, which is assembled as described above, therein.

As shown in FIG. 4, 5A-5C, the molded body 70 includes the molded resin portion 71 and the assembled body 80. The molded body 70 is formed by covering the top surface of the dielectric body 81 with the molded resin portion 71 in such a manner that the assembled body 80 is exposed at least at the power receiving portions 821, 831 and at the inner circumferential walls 824, 836 of the hole portions 823, 835.

The molded body 70 is formed by insert molding, for example. The molded resin portion 71 is fabricated from the same material (POM resin) as the dielectric body 81 of the assembled body 80. The molded resin portion 71 corresponds to a resin covering in the appended claims.

As shown in FIGS. 4, 5A-5C, the power receiving portions 821, 831 extend out of a top surface of the molded resin portion 71. The dielectric body 81 extends out of a bottom surface of the molded resin portion 71. As shown in FIGS. 5A, 5C, the molded resin portion 71 covers an entire body of the choke coil 84. The molded resin portion 71 covers also the one end 843 of the choke coil 84, the connecting portion 832, the other end 844 of the choke coil 84 and the connecting portion 838. The molded resin portion 71 covers peripheries of the hole portions 823, 835 to expose the inner circumferential walls 824, 836 of the hole portions 823, 835. As shown in FIGS. 4, 5C, the molded resin portion 71 that covers the peripheries of the hole portions 823, 835 has through holes 72 that penetrates through the hole portions 823, 835.

Thereby, the assembled body 80 is covered in the molded resin portion 71 except the power receiving portions 821, 831 and the inner circumferential walls 824, 836 of the hole portions 823, 835 that are for electrical connections. Therefore, an area in which the positive and negative terminals 82, 83 are exposed to a space between the bearing holder 50 and the discharge-side cover 60 is much smaller than in a conventional construction in which terminals are simply fixed to a holder. Therefore, even if the fuel is an alternative fuel that contains electrically conductive ingredients, it is possible to inhibit electric corrosion of the positive and negative terminals 82, 83, poor electrical continuity at the positive and negative terminals 82, 83 and breakage of the positive and negative terminals 82, 83.

Figure 10A:
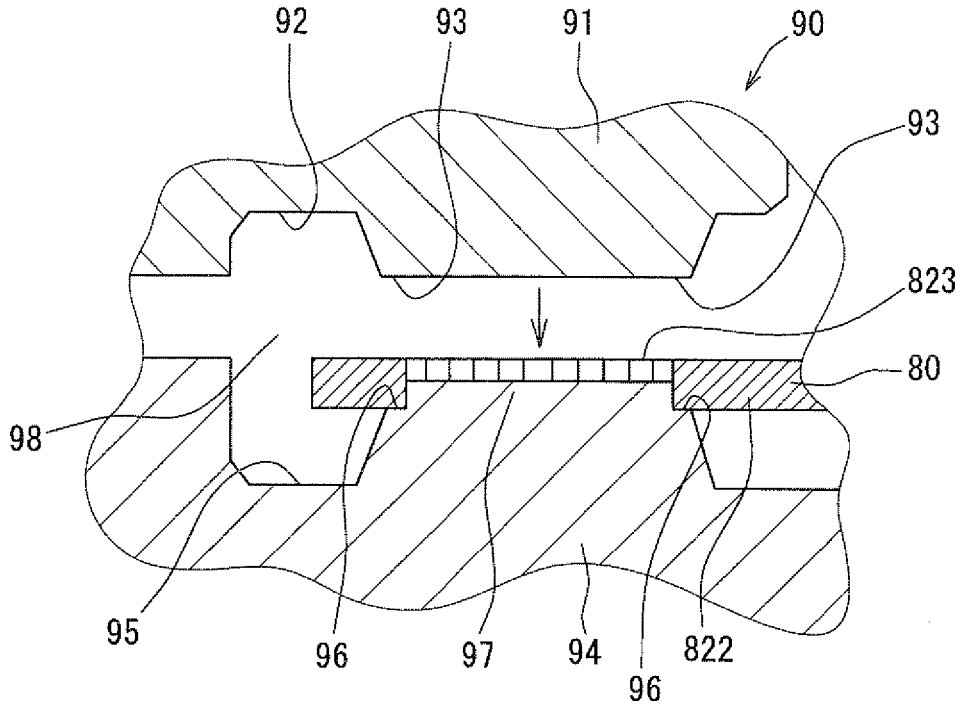
FIG. 10A is a cross-sectional view showing a state in which the assembled body is placed in a mold.
Figure 10B:
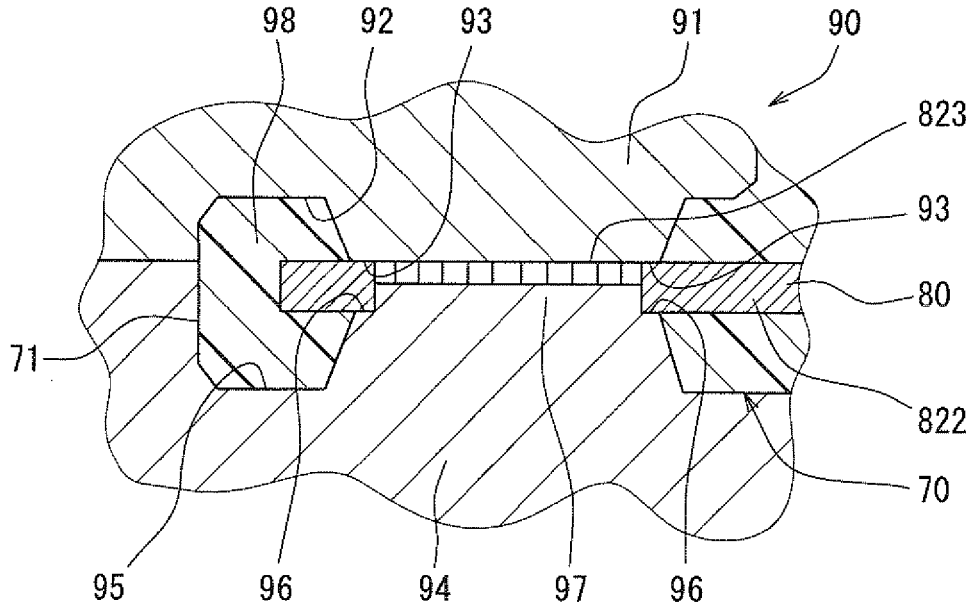
FIG. 10B is a cross-sectional view showing a state in which a molten resin is injected into the mold.

Next, molding process of the molded body 70 will be described hereafter with reference to FIGS. 10A, 10B. FIGS. 10A, 10B schematically show cross-sections of the hole portion 823 and its surroundings in the molding process. FIG. 10A shows a state in which the assembled body 80 is placed in a mold 90. FIG. 10B shows a state in which molten resin is injected into a cavity 98 in the mold 90.

The molded body 70 is fabricated by placing inserts, i.e., the assembled body 80 between an upper mold 91 and a lower mold 94 and injecting the molten resin into the cavity 98 defined between the upper and lower molds 91, 94. Molding process of a part of the molded resin portion 71 that surrounds the hole portion 823 will be described hereafter. Another part of the molded resin portion 71 that surrounds the hole portion 835 is formed substantially in the same manner.

As shown in FIG. 10A, the mold 90 includes the upper mold 91 and the lower mold 94 that interpose the hole portion 823 therebetween in an axial direction of the hole portion 823.

As shown in FIG. 10A, the upper mold 91 opens to a lower side. The upper mold 91 has a groove 92 and a contact portion 93. The groove 92 extends along the periphery of the hole portion 823. The contact portion 93 comes in contact with the periphery of the hole portion 823. The lower mold 94 opens to an upper side. The lower mold 94 has a groove 95 and a contact portion 96. The groove 95 extends along the periphery of the hole portion 823. The contact portion 96 comes in contact with the periphery of the hole portion 823. The lower mold 94 further has a positioning protrusion 97 radially inside the contact portion 96. The positioning protrusion 97 is for positioning the hole portion 823 in the mold 90.

As shown in FIG. 10B, the periphery of the hole portion 823 is clamped between the upper and lower molds 91, 94, and molten resin is injected into the cavity 98 that is defined by the grooves 92, 95. After the molten resin becomes solid, the molded body 70 is detached from the mold 90. By forming the molded resin portion 71 with the mold 90 as described above, the through hole 72 is formed in the molded resin portion 71 in such a manner that the through hole 72 penetrates through the hole portions 823, 835 (see FIGS. 4, 5C).

As described above, electrical connections between the positive and negative brush terminals 34*a*, 34*b* and the hole portions 823, 835 are realized by press-fitting the positive and negative brush terminals 34*a*, 34*b* upward into the hole portions 823, 835. Therefore, the molded resin portion 71 does not necessarily require the through holes 72, 72. In other words, even if tops of the through holes 72, 72 are closed, the positive and negative brush terminals 34*a*, 34*b* can be electrically connected with the hole portions 823, 835.

Figure 11A:
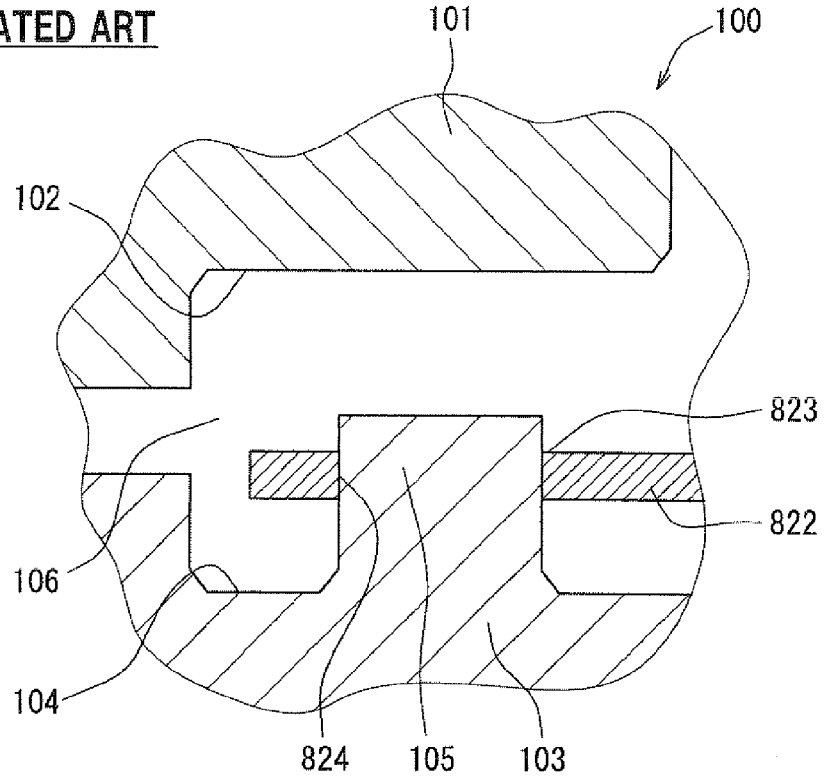
FIG. 11A RELATED ART
FIGS. 11A, 11B are cross-sectional views showing a comparative example against a molding process shown in FIGS. 10A, 10B.
Figure 11B:
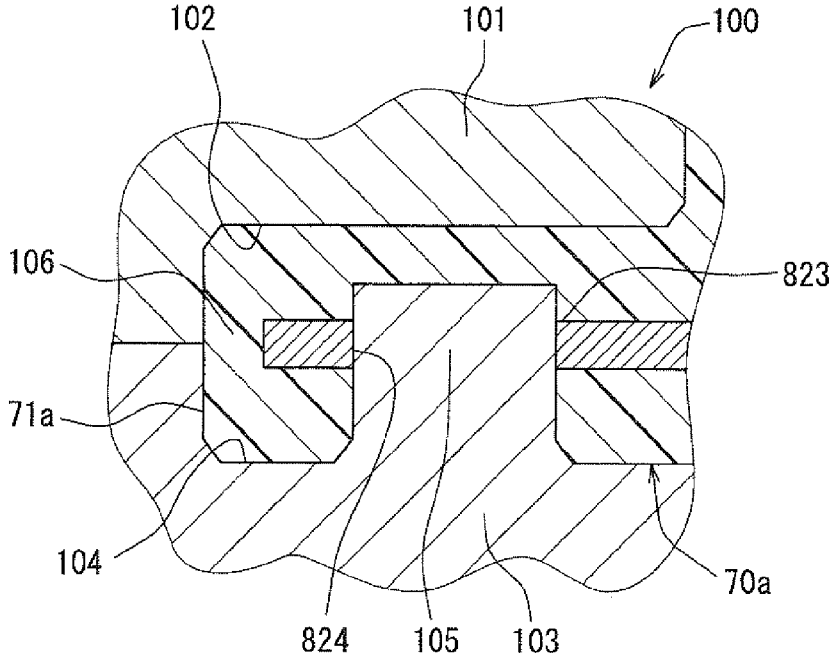
FIG. 11B RELATED ART

In order to form the molded resin portion 71 in such a manner that the tops of the through holes 72, 72 are closed, a mold 100 should have a construction as shown in FIGS. 11A, 11B. FIG. 11A is a diagram corresponding to FIG. 10A, and FIG. 11B is a diagram corresponding to FIG. 10B. The same reference numerals are assigned to the same or equivalent parts across the first embodiment shown in FIGS. 10A, 10B and a comparative example shown in FIGS. 11A, 11B. Molding process of a molded resin portion 71*a* at a part surrounding the hole portion 823 will be described hereafter.

Specifically, as shown in FIG. 11A, an upper mold 101 opens to a lower side. The upper mold 101 and has a depressed portion 102 that fully covers the hole portion 823. A lower mold 103 opens to an upper side. The lower mold 103 has a groove 104 that extends along the periphery of the hole portion 823, and a protruding portion 105 that is inserted inside the inner circumferential wall 824 of the hole portion 823.

As shown in FIG. 11B, the upper mold 101 is abutted against the lower mold 103, and molten resin is injected into a cavity 106 that is defined by the depressed portion 102 and the groove 104. After the molten resin becomes solid, a molded body 70*a* is detached from the mold 100. By forming the molded resin portion 71*a* with the mold 100 as described above, a hole is formed in the molded resin portion 71*a* in such a manner that the hole opens to the lower side and a top of the hole is closed.

As shown in FIG. 11B, the protruding portion 105 of the lower mold 103 is simply inserted inside the inner circumferential wall 824 of the hole portion 823. Therefore, when the molten resin is injected into the cavity 106, the molten resin can enter a gap between a side surface of the protruding portion 105 and the inner circumferential wall 824 of the hole portion 823. If the molten resin comes into this gap, a solidified resin can be left on the inner circumferential wall 824 of the hole portion 823. Even if the positive brush terminal 34*a* is press-fitted into the hole portion 823 in this state, electrical continuity between the relay terminal portion 822 and the positive brush terminal 34*a* cannot be established and a poor electrical contact is caused, so that yields of the molded body 70*a* are reduced.

In order to improve yields of the molded body 70*a*, entry of the molten resin into the above-mentioned gap can be prevented by improving accuracy of dimensions of a diameter of the protruding portion 105 of the lower mold 103 and an inner diameter of the hole portion 823. However, this method raises manufacturing cost of the molded body 70*a*.

In the present embodiment, the molded resin portion 71 has the above-mentioned through hole 72 that penetrates through the hole portion 823, as shown in FIGS. 10A, 10B Therefore, the mold 90 for molding the molded resin portion 71 does not require a shape as the mold 100 as shown in FIGS. 11A, 11B. That is, the lower mold 94 of the mold 90 does not require the protruding portion 105 that is inserted into the hole portion 823 (see FIGS. 11A, 11B).

In the present embodiment, the upper and lower molds 91, 94 have the contact portions 93, 96, respectively, as shown in FIGS. 10A, 10B. The contact portions 93, 96 extend along inner circumferences of the grooves 92, 95, and come in contact with the periphery of the hole portion 823. Therefore, it is possible to prevent the molten resin from entering the hole portion 823 from the grooves 92, 95, by abutting the upper mold 91 against the lower mold 94. Therefore, it is possible to improve yields of the molded body 70 without raising manufacturing cost.

Figure 12:
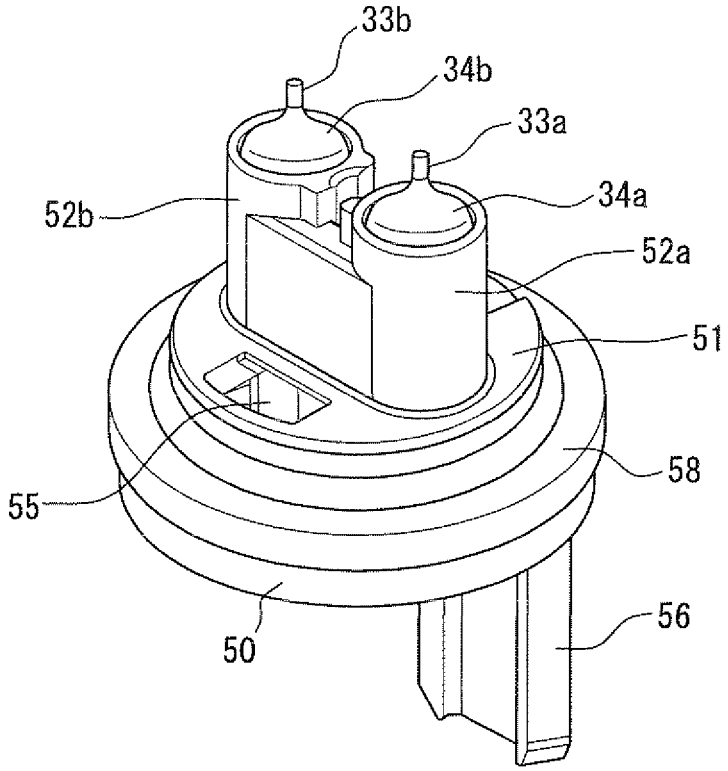
FIG. 12 is a perspective view showing the bearing holder of the fuel pump according to the first embodiment.

Next, a construction of the bearing holder 50 in the present embodiment will be explained with reference to FIGS. 2A, 2B, 12, 13A-13D. FIG. 12 is a perspective view showing the bearing holder 50 in which the brush springs 31*a*, 31*b* and the positive and negative brush terminals 34*a*, 34*b* are installed. FIGS. 13A-13D are a top view, a side view, a front view and a bottom view, respectively, of the bearing holder 50 that is shown in FIG. 12.

The bearing holder 50 is fabricated from PPS (polyphenylene sulfide) resin, for example. As shown in FIGS. 12, 13A-13D, the bearing holder 50 has a base portion 51 that has an approximately disk-like shape. Two pipe portions 52*a*, 52*b* are formed on a central portion of a top surface of the base portion 51. The pipe portions 52*a*, 52*b* extend side by side toward the discharge-side cover 60 (see FIGS. 2A, 2B).

The positive and negative brushes 32*a*, 32*b*, the brush springs 31*a*, 31*b* and the positive and negative brush terminals 34*a*, 34*b* are arranged in this order from a lower side to an upper side, and are installed in the pipe portions 52*a*, 52*b* (see FIGS. 2A, 2B). The positive and negative brushes 32*a*, 32*b* are installed in the pipe portions 52*a*, 52*b*, respectively, in such a manner that the positive and negative brushes 32*a*, 32*b* are axially slidable. The positive and negative brush terminals 34*a*, 34*b* are fixed to the bearing holder 50 by being press-fitted into inner circumferential walls of the pipe portions 52*a*, 52*b* in a state that the connecting wires 33*a*, 33*b* are connected with the positive and negative brush terminals 34*a*, 34*b*. Top portions of the positive and negative brush terminals 34*a*, 34*b* protrude out of top ends of the pipe portions 52*a*, 52*b* so that the positive and negative brush terminals 34*a*, 34*b* can be press-fitted into the hole portions 823, 835 of the relay terminal portions 822, 834.

Figure 13A:
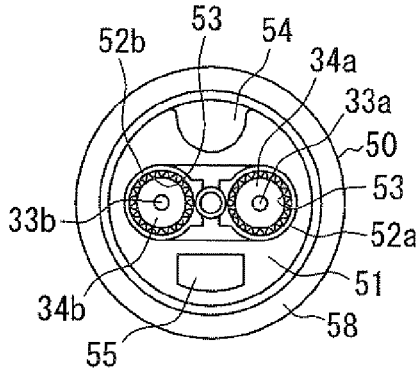
FIGS. 13A-13D are a top view, a side view, a front view and a bottom view, respectively, of the bearing holder of the fuel pump according to the first embodiment.

As shown in FIG. 13A, the inner circumferential walls of the pipe portions 52*a*, 52*b* have protrusions 53, 53 that protrude radially inward in the pipe portions 52*a*, 52*b*. Thereby, press-fitting forces for press-fitting the positive and negative brush terminals 34*a*, 34*b* into the pipe portions 52*a*, 52*b* are decreased. Moreover, since the tips of the protrusions 53, 53 are deformed flat when the positive and negative brush terminals 34*a*, 34*b* are press-fitted into the pipe portions 52*a*, 52*b*, outer circumferential walls of the pipe portions 52*a*, 52*b* are destressed. Therefore, it is possible to inhibit generation of cracks on the pipe portions 52*a*, 52*b* and to inhibit electric corrosion that is caused by fuel entering through the cracks.

Figure 13B:
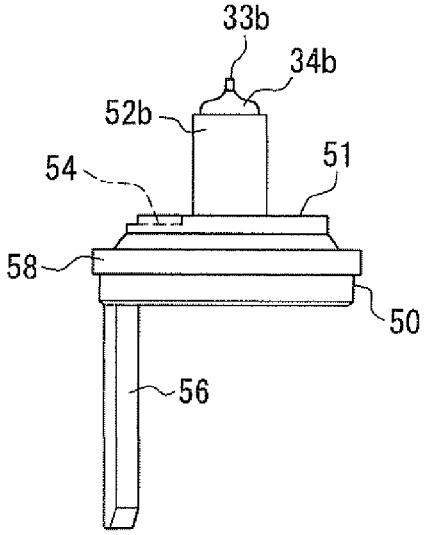

As shown in FIGS. 13A, 13B, a concave portion 54 is formed on the base portion 51. A convex portion 816 (see FIGS. 2A, 2B, 5A, 5B) that is formed on a bottom portion of the molded body 70 is fitted to the concave portion 54. As shown in FIG. 2, the molded body 70 is placed on the top surface of the base portion 51 in such a manner that the hole portions 823, 835 are opposed to the pipe portions 52*a*, 52*b*. In this state, the top portions of the positive and negative brush terminals 34*a*, 34*b* are press-fitted into the hole portions 823, 835.

The positive and negative brush terminals 34*a*, 34*b* are fixed on inner circumferential walls of the pipe portions 52*a*, 52*b*, so that the positive and negative brush terminals 34*a*, 34*b* can be easily inserted into the hole portions 823, 835 of the relay terminal portions 822, 834.

In this embodiment, the positive and negative brush terminals 34*a*, 34*b* is fixed to the pipe portions 52*a*, 52*b* by press-fitting; however, the method for fixing the positive and negative brush terminals 34*a*, 34*b* to the pipe portions 52*a*, 52*b* is not limited to press-fitting. For example, it is also possible to fix the positive and negative brush terminals 34*a*, 34*b* to the pipe portions 52*a*, 52*b* by insert molding, by adhesive, etc.

As shown in FIGS. 4, 5C, since the protrusions 825, 837 are formed on the inner circumferential walls 824, 836 of the hole portions 823, 835, the press-fitting forces for press-fitting the top portions of the positive and negative brush terminals 34*a*, 34*b* into the hole portions 823, 835 are decreased. Moreover, since the tips of the protrusions 825, 837 are deformed flat when the top portions of the positive and negative brush terminals 34*a*, 34*b* are press-fitted into the hole portions 823, 835, the peripheries of the hole portions 823, 835 are destressed. Therefore, it is possible to inhibit generation of cracks on the molded resin portion 71 that covers the peripheries of the hole portions 823, 835 and to inhibit electric corrosion that is caused by fuel entering through the cracks.

Figure 13C:
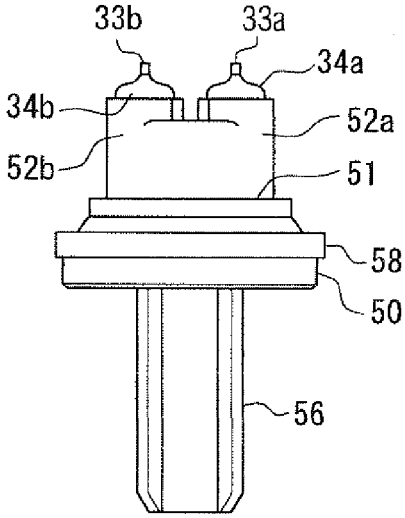
Figure 13D:
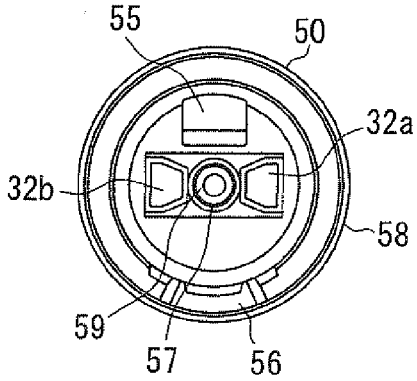

As shown in FIGS. 12, 13A, 13D, a hole 55 is formed on the base portion 51 in such a manner that the pipe portions 52*a*, 52*b* are interposed between the concave portion 54 and the hole 55. The fuel in an inside of the housing 21 flows through the hole 55 to an inside of the discharge-side cover 60.

As shown in FIGS. 12, 13B, 13C, a latch portion 56 extends downward from a bottom surface of the base portion 51. The latch portion 56 and the concave portion 54 are arranged back to back on the base portion 51. The latch portion 56 latches the permanent magnets 22 unrotatably, and keeps the permanent magnets 22 in a predetermined position. As shown in FIG. 13D, a bearing holding hole 57 that holds the bearing 59 is formed in the central portion of the base portion 51. Moreover, a flange portion 58 is formed on a periphery of the base portion 51. The flange portion 58 extends along an entire circumference of the base portion 51.

Figure 14:
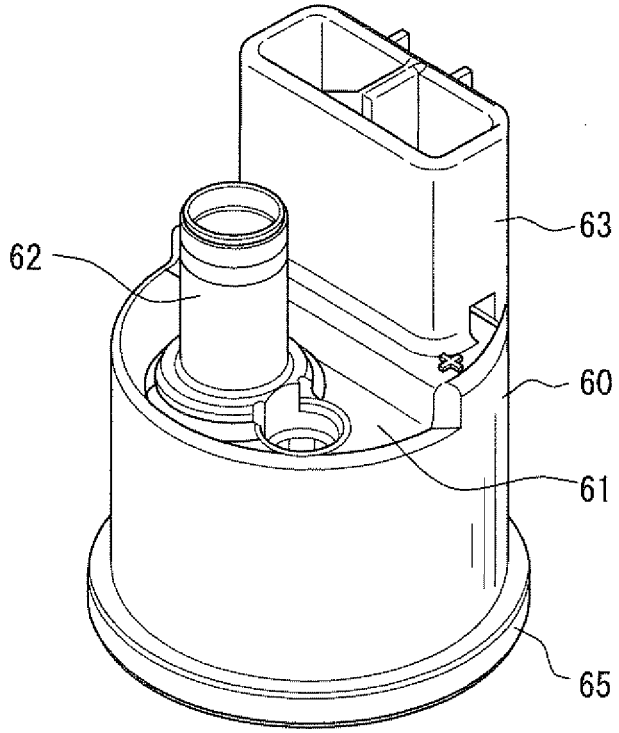
FIG. 14 is a perspective view showing the discharge-side cover of the fuel pump according to the first embodiment.

Next, a construction of the discharge-side cover 60 in the present embodiment will be described, with reference to FIGS. 2A, 2B, 14, 15A-15D. FIG. 14 is a perspective view showing the discharge-side cover 60. FIGS. 15A-15D are a top view, a side view, a front view and a bottom view, respectively, of the discharge-side cover 60.

The bearing holder 50 is fabricated from PPS resin or POM resin, for example. As shown in FIGS. 14, 15A-15C, the discharge-side cover 60 has a cylindrical shape. The discharge-side cover 60 has a top wall 61 in an upper portion thereof. A connector portion 63 and the fuel discharge portion 62 extend upward from the top wall 61. The connector portion 63 and the fuel discharge portion 62 are arranged in such a manner that a center of the top wall 61 is interposed between the connector portion 63 and the fuel discharge portion 62.

Figure 15A:
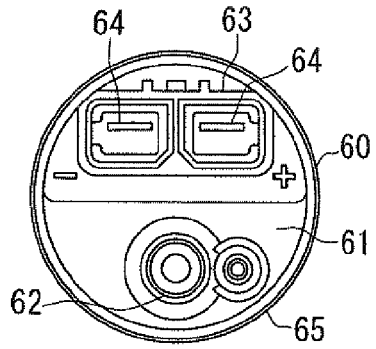
FIGS. 15A-15D are a top view, a side view, a front view and a bottom view, respectively, of the discharge-side cover of the fuel pump according to the first embodiment.
Figure 15B:
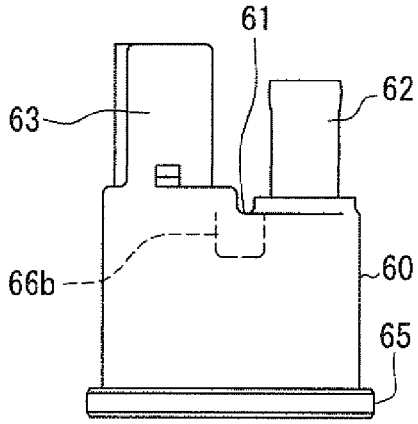
Figure 15C:
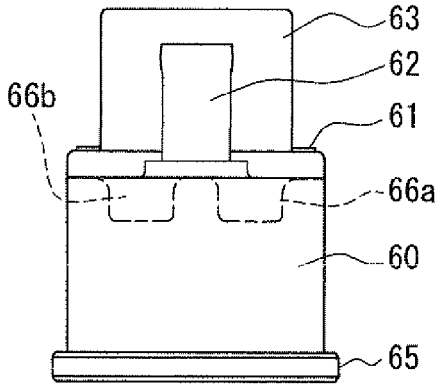
Figure 15D:
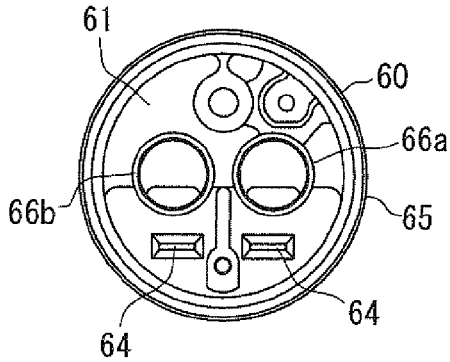

As shown in FIGS. 15A, 15D, an inside space of the connector portion 63 is partitioned into two rooms. A bottom of the connector portion 63 has insertion holes 64, 64 in which the power receiving portions 821, 831 of the positive and negative terminals 82, 83 are inserted. In FIG. 15A, the power receiving portion 821 of the positive terminal 82 is inserted in a right one of the insertion holes 64, 64, and the power receiving portion 831 of the negative terminal 83 is inserted in a left one of the insertion holes 64, 64.

As shown in FIGS. 14, 15B, 15C, a flange portion 65 is formed in a bottom portion of the discharge-side cover 60. The flange portion 65 extends radially outward from a whole circumference of the discharge-side cover 60. The flange portion 65 is axially opposed to the above-mentioned flange portion 58 of the bearing holder 50.

As shown in FIGS. 15B-15D, two pipe portions 66*a*, 66*b* are formed on a lower surface of the top wall 61. The pipe portions 66*a*, 66*b* are arranged inside the discharge-side cover 60, and extend downward from the lower surface of the top wall 61. The pipe portions 66*a*, 66*b* are formed to extend toward the top ends of the pipe portions 52*a*, 52*b* of the bearing holder 50.

FIG. 3 is a cross-sectional view showing an arrangement of the bearing holder 50, which is shown in FIGS. 12, 13A-13D, the discharge-side cover 60, which is shown in FIGS. 14, 15A-15D and the molded body 70, which is shown in FIGS, 4, 5A-5C. In FIG. 3, the molded body 70 is attached to the bearing holder 50, and a molded body 70 side of the bearing holder 50 is covered with the discharge-side cover 60.

As shown in FIG. 3, by putting the bearing holder 50, the mold body 70 and the discharge-side cover 60 together in an axial direction, a part of the molded resin portion 71 that surrounds the hole portions 823, 835 is clamped between the pipe portions 52*a*, 52*b* of the bearing holder 50 and the pipe portions 66*a*, 66*b* of the discharge-side cover 60.

This construction prevents the fuel, which contains electrically conductive ingredients and flows in the discharge-side cover 60, from entering into a space in which the relay terminal portions 822, 834 are connected with the positive and negative brush terminals 34*a*, 34*b*. Then, positive terminal parts such as the relay terminal portion 822 and the positive brush terminal 34*a* are isolated from negative terminal parts such as the relay terminal portion 834 and the negative brush terminal 34*b*. Therefore, it is possible to inhibit current leakage between the positive terminal parts and the negative terminal parts. Even if fuel inflow into the space in which the relay terminal portions 822, 834 are connected with the positive and negative brush terminals 34*a*, 34*b* cannot be perfectly prevented, an amount of the fuel inflow can be reduced. Therefore, electric resistance between the positive terminal parts and negative terminal parts can be increased and the current leakage is restricted. Accordingly, even if the fuel is an alternative fuel that contains electrically conductive ingredients, it is possible to inhibit electric corrosion of the terminal parts such as the relay terminal portions 822, 834 and the positive and negative brush terminals 34*a*, 34*b*, poor electrical continuity at the terminal parts and breakage of the terminal parts.

In the construction according to the present embodiment, the relay terminal portions 822, 834 are electrically connected with the positive and negative brush terminals 34*a*, 34*b* by press-fitting the positive and negative brush terminals 34*a*, 34*b* into the hole portions 823, 835 that are formed in the relay terminal portions 822, 834.

The peripheries of the hole portions 823, 835 of the relay terminal portions 822, 834 are covered with the molded resin portion 71. The molded resin portion 71 is clamped between the pipe portion 52*a*, 52*b* of the bearing holder 50 and the pipe portions 66*a*, 66*b* of the discharge-side cover 60 in a vertical direction.

By this construction, it is possible to isolate the space in which the relay terminal portions 822, 834 are connected with the positive and negative brush terminals 34*a*, 34*b* from the fuel as perfectly as possible. As a result, it is possible to inhibit electric corrosion of the terminal parts more efficiently.

In the construction according to the present embodiment, the positive and negative brush terminals 34*a*, 34*b*, the connecting wires 33*a*, 33*b* and the positive and negative brushes 32*a*, 32*b* are accommodated in the pipe portions 52*a*, 52*b*, and the relay terminal portions 822, 834 are clamped between the pipe portions 52*a*, 52*b* and the pipe portions 66*a*, 66*b*.

This construction inhibits fuel inflow into insides of the pipe portions 52*a*, 52*b*, 66*a*, 66*b*. This construction also isolates the positive terminal parts between the relay terminal portion 822 and the positive brush 32*a*, which are accommodated in the pipe portions 52*a*, 66*a*, from the negative terminal parts between the relay terminal portion 834 and the negative brush 32*b*, which are accommodated in the pipe portions 52*b*, 66*b*. Thereby, it is possible to inhibit current leakage between the positive terminal parts and the negative terminal parts. Even if the fuel inflow into the pipe portions 52*a*, 52*b*, 66*a*, 66*b* that accommodate the positive and negative terminal parts cannot be perfectly prevented, an amount of the fuel inflow can be reduced. Therefore, it is possible to inhibit electric corrosion of the positive and negative terminal parts, poor electrical continuity at the positive and negative terminal parts and breakage of the positive and negative terminal parts.

Moreover, the pipe portions 52*a*, 52*b* have two actions. That is, the pipe portions 52*a*, 52*b* support the positive and negative brushes 32*a*, 32*b*. The pipe portions 52*a*, 52*b* also inhibit the fuel inflow into the insides of the pipe portions 52*a*, 52*b*, 66*a*, 66*b* by clamping the relay terminal portions 822, 834 between the pipe portions 52*a*, 52*b* and the pipe portions 66*a*, 66*b*. Therefore, it is possible to simplify the construction of the bearing holder 50.

As shown in FIG. 3, the bearing holder 50 and the discharge-side cover 60 have a construction to leave a small clearance L1 between a top surface of the flange portion 58 of the bearing holder 50, which is shown in FIGS. 13B, 13C, and a bottom surface of the flange portion 65 of the discharge-side cover 60, which is shown in FIGS. 15B, 15C, when the discharge-side cover 60 is attached to the bearing holder 50 in such a manner that the relay terminal portions 822, 834 is clamped between the pipe portions 52*a*, 52*b* and the pipe portions 66*a*, 66*b*. By this construction, the flange portion 58 of the bearing holder 50 and the flange portion 65 of the discharge-side cover 60, which are opposed to each other, do not restrict a movement of the discharge-side cover 60 toward the bearing holder 50 when the discharge-side cover 60 is attached to the bearing holder 50, until the relay terminal portions 822, 834 are clamped between the pipe portions 52*a*, 52*b* and the pipe portions 66*a*, 66*b*. That is, it is possible to catch the relay terminal portions 822, 834 securely between the pipe portions 52*a*, 52*b* and the pipe portions 66*a*, 66*b*. Therefore, it is possible to inhibit the fuel inflow into the insides of the pipe portions 52*a*, 52*b*, 66*a*, 66*b* to a minimum, and to inhibit electric corrosion of the positive and negative terminal parts effectively.

(Second Embodiment)

Figure 16A:
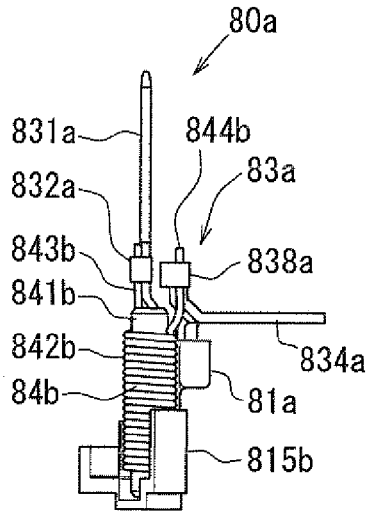
FIGS. 16A-16C are a side view, a front view and a top view, respectively, of an assembled body that is embedded in a molded body of a fuel pump according to a second embodiment of the present invention.
Figure 16B:
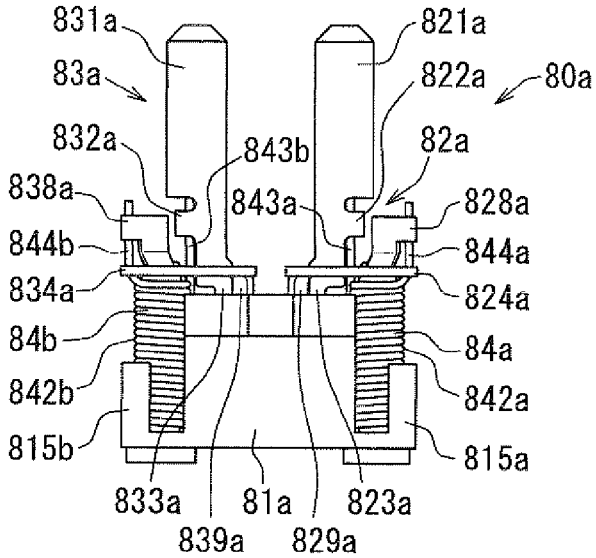
Figure 16C:
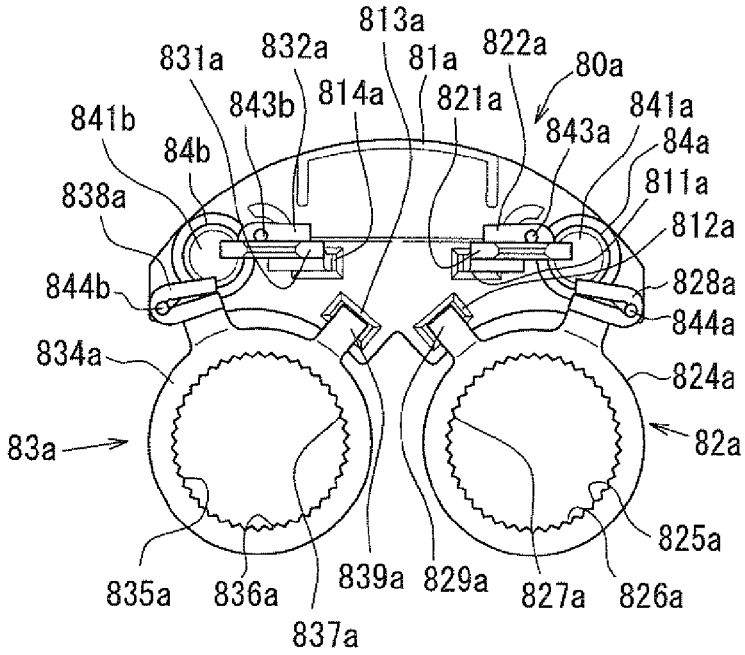

In the above-described first embodiment, the choke coil 84 is placed only on a negative terminal 83 side (see FIGS. 6-9). In contrast, an assembled body 80*a* in the second embodiment has choke coils 84*a*, 84*b* on both of a positive terminal 82*a* side and a negative terminal 83*a* side. FIGS. 16A-16C are a side view, a front view and a top view, respectively, of the assembled body 80*a* in the second embodiment.

As shown in FIGS. 16A-16C, the assembled body 80*a* has a construction in which a positive terminal 82*a*, a negative terminal 83*a* and the choke coils 84*a*, 84*b* are attached to a dielectric body 81*a*. The positive and negative terminals 82*a*, 83*a* are for receiving electric power supplied from an external electric power source.

The positive and negative terminals 82*a*, 83*a* have power receiving portions 821*a*, 831*a* and relay terminal portions 824*a*, 834*a* The power receiving portions 821*a*, 831*a* are formed separately from the relay terminal portions 824*a*, 834*a*. The power receiving portions 821*a*, 831*a* and the relay terminal portions 824*a*, 834*a* are fabricated from flat conductive material, respectively. The choke coils 84*a*, 84*b* are electrically connected between the power receiving portions 821*a*, 831*a* and the relay terminal portions 824*a*, 834*a*.

The power receiving portions 821*a*, 831*a* have anchors 823*a*, 833*a* at their one ends opposite from power receiving ends to which electric power is supplied from the external electric power source. The power receiving portions 821*a*, 831*a* are attached to the dielectric body 81*a* at the anchors 823*a*, 833*a*. The relay terminal portions 824*a*, 834*a* are bent into approximate L-shapes. The relay terminal portions 824*a*, 834*a* have hole portions 825*a*, 835*a* at their one ends, and anchors 829*a*, 839*a* at their another ends. The relay terminal portions 824*a*, 834*a* are attached to the dielectric body 81*a* at the anchors 829*a*, 839*a*.

Positive and negative brush terminals 34*a*, 34*b* are press-fitted into the hole portion 825*a*, 835*a* of the relay terminal portions 824*a*, 834*a*. Inner circumferential walls 826*a*, 836*a* of the hole portions 825*a*, 835*a* have protrusions 827*a*, 837*a* that protrude radially inward in the hole portions 825*a*, 835*a*. Thereby, press-fitting forces for press-fitting the positive and negative brush terminals 34*a*, 34*b* into the hole portions 825*a*, 835*a* are decreased.

The choke coils 84*a*, 84*b* are formed by winding winding wires 842*a*, 842*b* around cylindrical choke coil cores 841*a*, 841*b*. One end 843*a* of the winding wire 842*a* is connected with the power receiving portion 821*a*, and the other end 844*a* of the winding wire 842*a* is connected with the relay terminal portion 824*a*. In an analogous fashion, one end 843*b* of the winding wire 842*b* is connected with the power receiving portion 831*a*, and the other end 844*b* of the winding wire 842*b* is connected with the relay terminal portion 834*a*.

The dielectric body 81*a* is fabricated from POM resin, for example, in an approximately rectangular parallelepiped shape. The dielectric body 81*a* has four insertion holes 811*a*, 812*a*, 813*a*, 814*a* and two choke coil holders 815*a*, 815*b*. The insertion holes 811*a*, 812*a*, 813*a*, 814*a* extend downward from a top surface of the dielectric body 81*a*. The choke coil holders 815*a*, 815*b* are formed on a sidewall of the dielectric body 81*a*.

The anchor 823*a* of the power receiving portion 821*a*, the anchor 829*a* of the relay terminal portion 824*a*, the anchor 839*a* of the relay terminal portion 834*a* and the anchor 833*a* of the power receiving portion 831*a* are press-fitted into the insertion holes 811*a*, 812*a*, 813*a*, 814*a*, which are arranged in this order from right to left in FIG. 16C.

The anchors 823*a*, 829*a*, 839*a*, 833*a* are press-fitted into the insertion holes 811*a*, 812*a*, 813*a*, 814*a* in such a manner that the power receiving portions 821*a*, 831*a* extend upward from the top surface of the dielectric body 81*a* and that the relay terminal portions 824*a*, 834*a* extend frontward from the top surface of the dielectric body 81*a*.

As shown in FIGS. 16B, 16C, the choke coil 84*a* is inserted in the choke coil holder 815*a*, which is a right one of the two choke coil holders 815*a*, 815*b*, and the choke coil 84*b* is inserted in the choke coil holder 815*b*, which is a left one of the two choke coil holders 815*a*, 815*b*. The choke coils 84*a*, 84*b* are inserted into the dielectric body 81*a* in such a manner that the choke coils 84*a*, 84*b* extend in a direction approximately in parallel with the power receiving portions 821*a*, 831*a*.

The one end 843*a* of the choke coil 84*a* is connected with a connecting portion 822*a* of the power receiving portion 821*a* by heat swaging or fusing, and the other end 844*a* of the choke coil 84*a* is connected with a connecting portion 828*a* of the relay terminal portion 824*a* by heat swaging or fusing.

In an analogous fashion, the one end 843*b* of the choke coil 84*b* is connected with a connecting portion 832*a* of the power receiving portion 831*a* by heat swaging or fusing, and the other end 844*b* of the choke coil 84*b* is connected with a connecting portion 838*a* of the relay terminal portion 834*a* by heat swaging or fusing.

A molded resin portion is formed by placing the assembled body 80*a*, which is assembled as described above, in such a mold 90 as shown in FIG. 10 and injecting molten resin into a cavity 98 defined in the mold 90. The power receiving portions 821*a*, 831*a* and the hole portions 825*a*, 835*a* are exposed out of the molded resin portion.

(Third Embodiment)

Figure 17:
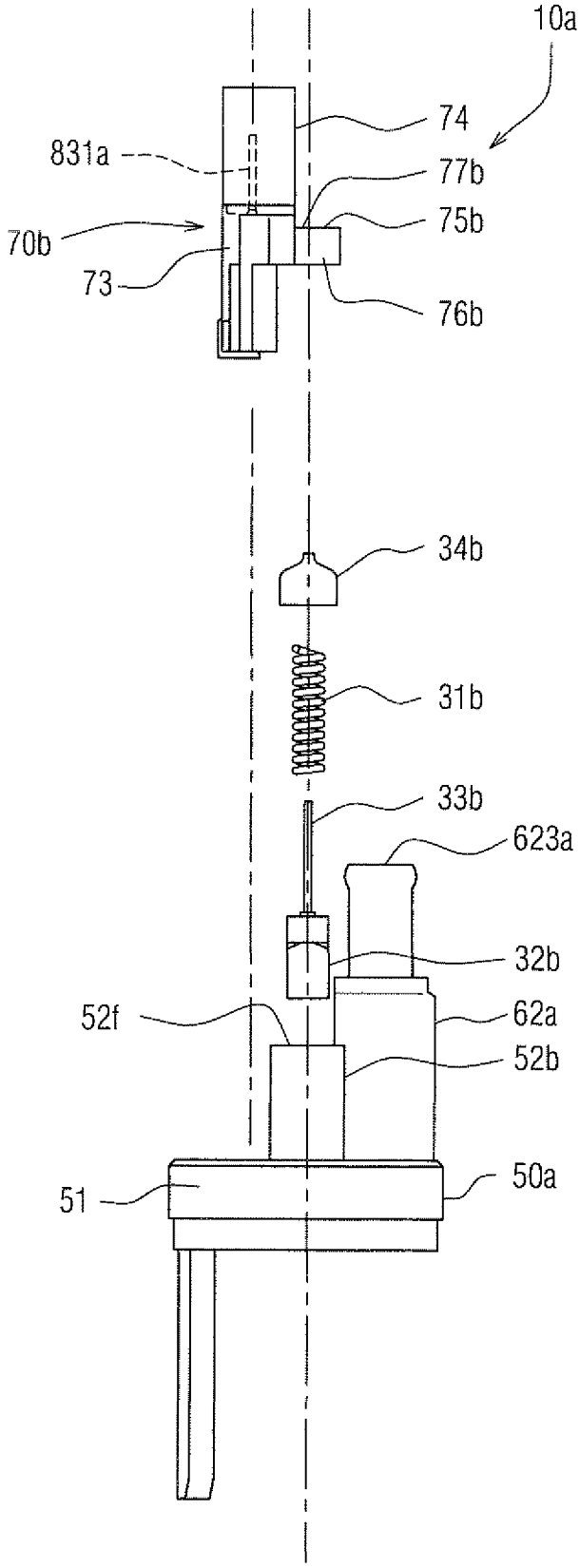
FIG. 17 is an exploded side view of a bearing holder, a molded body and other parts arranged in the bearing holder of a fuel pump according to a third embodiment.
Figure 18:
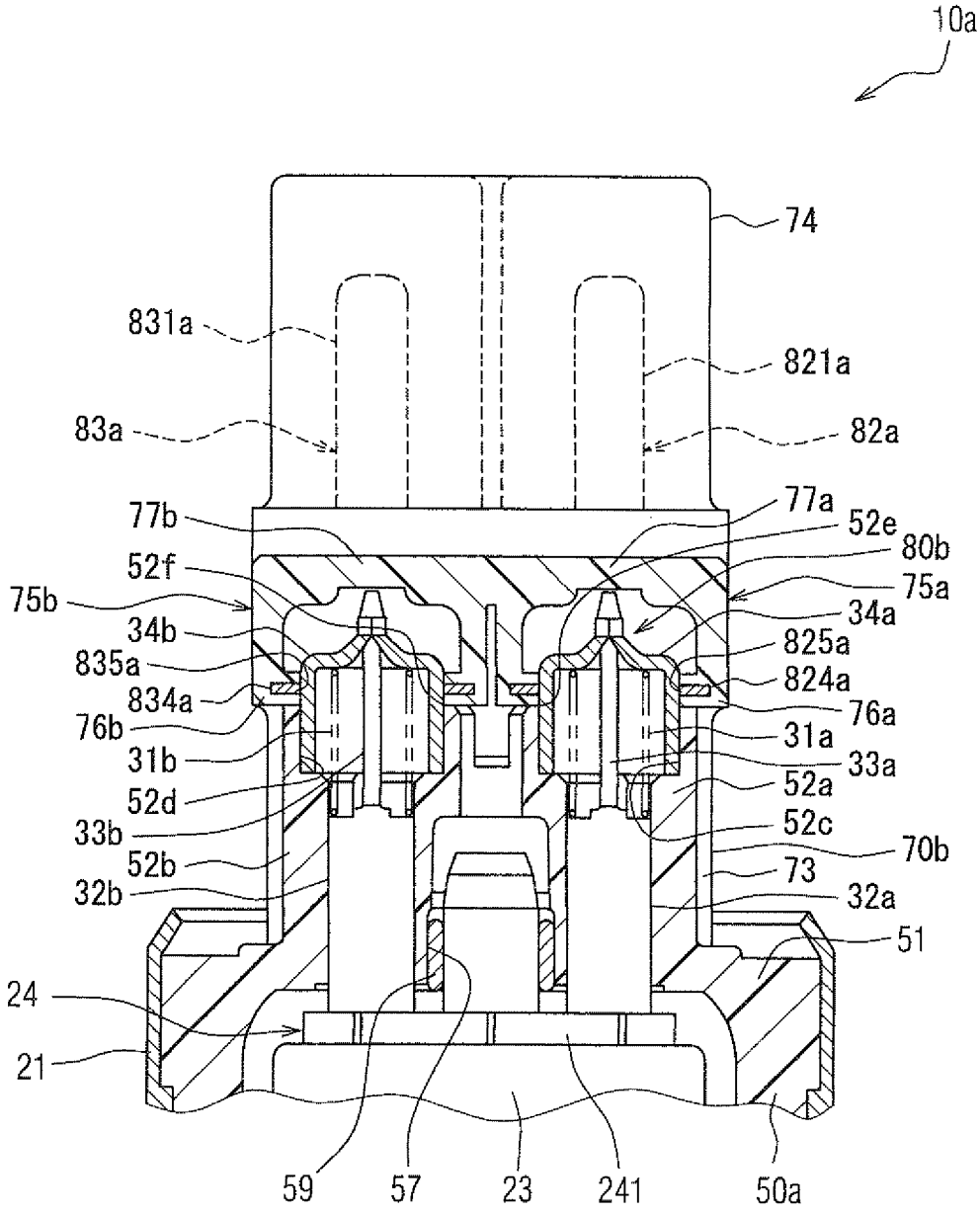
FIG. 18 is a cross-sectional view showing an arrangement of the bearing holder, the molded body and other parts arranged in the bearing holder of the fuel pump shown in FIG. 17.
Figure 19:
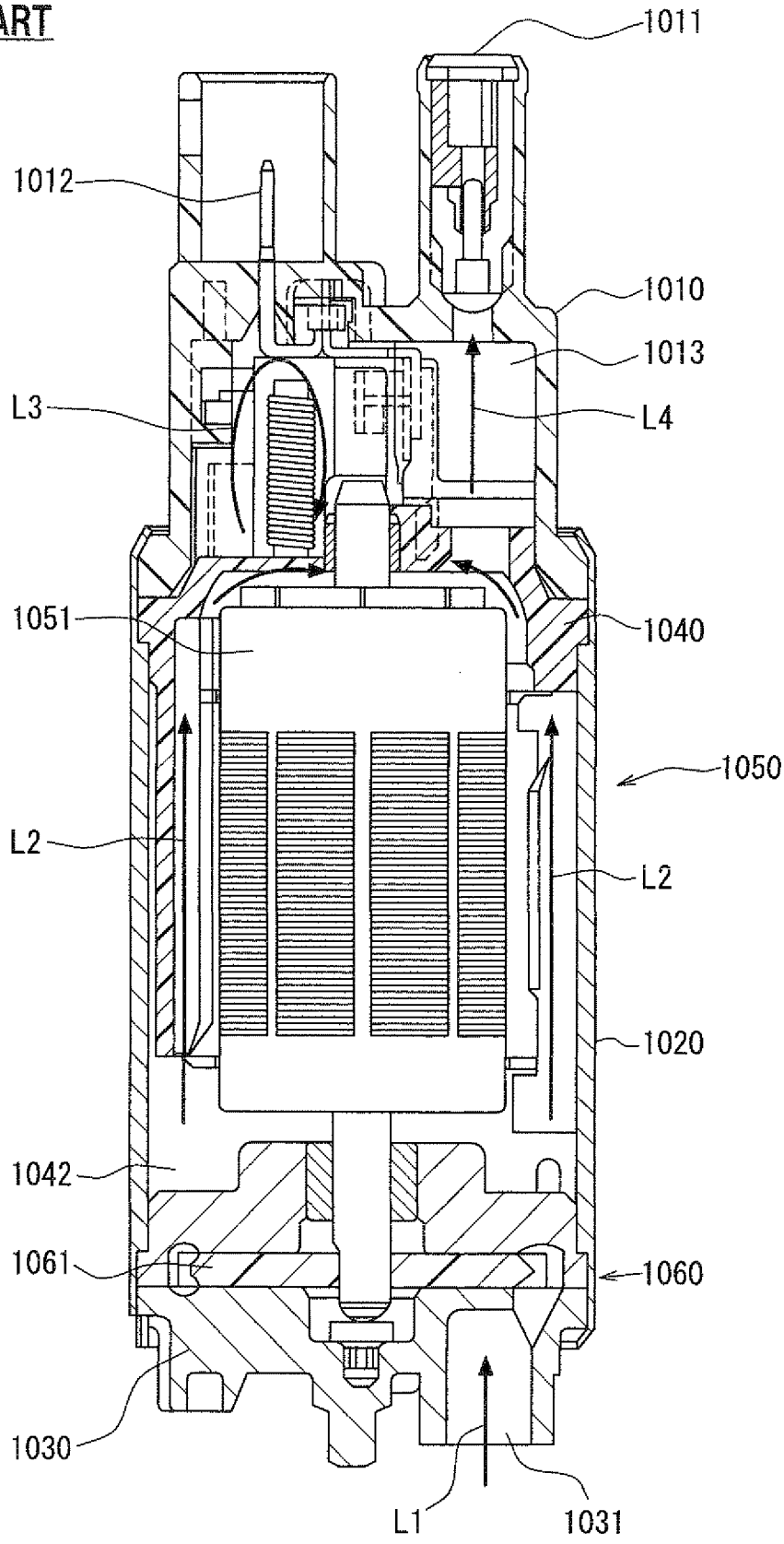
FIG. 19 PRIOR ART
FIG. 19 is a cross-sectional view showing a conventional fuel pump.
Figure 20:
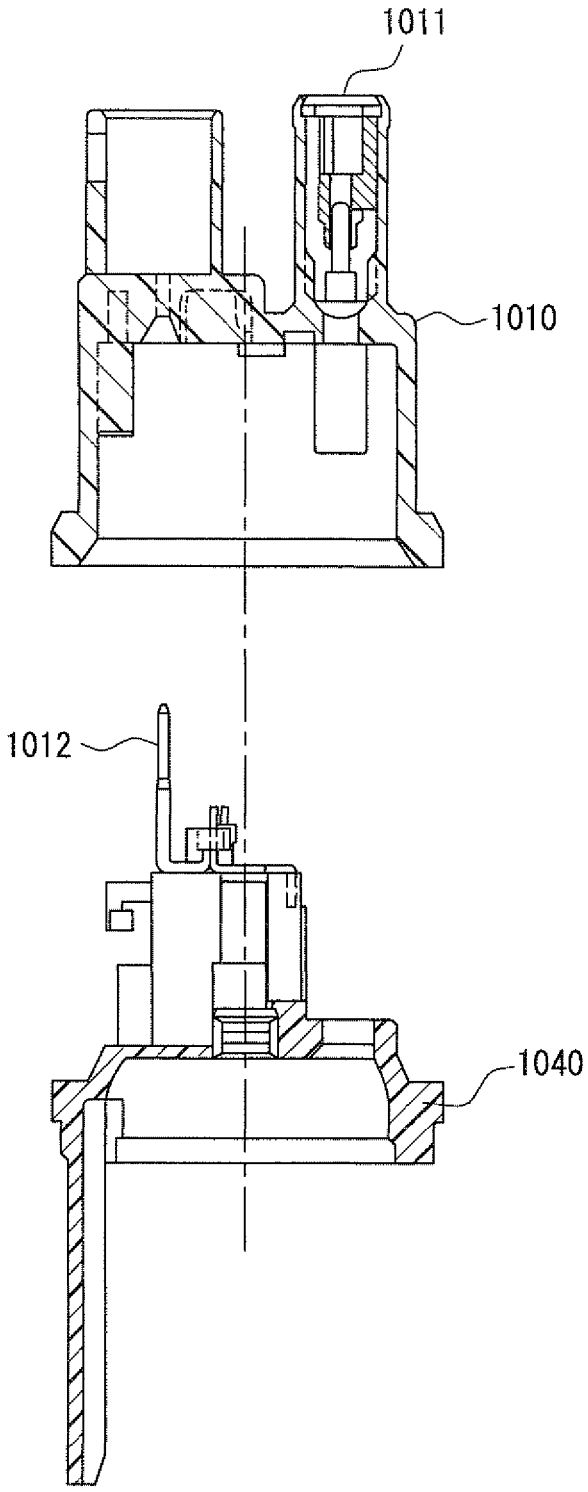
FIG. 20 PRIOR ART
FIG. 20 is an exploded cross-sectional view showing a bearing holder and a discharge-side cover, which are shown in FIG. 19.

A third embodiment of the present invention is a modification of the first embodiment As shown in FIGS. 17, 18, a fuel pump 10*a* according to the third embodiment of the present invention is different from the fuel pump 10 according to the first embodiment in that the fuel pump 10*a* does not have the discharge-side cover 60 that is provided with the fuel discharge portion 62. The fuel pump 10*a*, particularly differences of the fuel pump 10*a* from the fuel pump 10 according to the first embodiment will be described in the following. The same reference numerals are assigned to the same or equivalent parts across the third embodiment and the first and the second embodiments.

FIG. 17 is an exploded side view showing a bearing holder 50*a*, a molded body 70*b*, and other parts arranged in the bearing holder 50*a* in the fuel pump 10*a* according to the third embodiment of the present invention. FIG. 18 is a cross-sectional view showing an arrangement of the bearing holder 50*a*, the molded body 70*b* and other parts arranged in the bearing holder 50*a* in the fuel pump 10*a*, which are shown in FIG. 17.

The fuel pump 10*a* according to the third embodiment of the present invention is a fuel pump that is placed in a fuel tank (not shown), and pumps fuel reserved in the fuel tank to an outside of the fuel tank. As shown in FIGS. 17, 18, in the third embodiment of the present invention, a discharge-side end portion of the fuel pump 10*a* includes the bearing holder 50*a*, the molded body 70*b*, a positive brush terminal 34*a*, a negative brush terminal 34*b*, brush springs 31*a*, 31*b*, connecting wires 33*a*, 33*b*, a positive brush 32*a* and a negative brush 32*b*.

The bearing holder 50*a* is fabricated from PPS (polyphenylene sulfide) resin, for example. As shown in FIG. 17, the bearing holder 50*a* has a base portion 51 that has an approximately disk-like shape. Two pipe portions 52*a*, 52*b* are formed on a central portion of a top surface of the base portion 51. The pipe portions 52*a*, 52*b* extend side by side. Furthermore, a fuel discharge portion 62*a* is formed on the top surface of the base portion 51. The fuel discharge portion 62*a* has a fuel discharge port 623*a* in its top end portion. The fuel discharge port 623*a* is connected with a space 211 that is formed in a housing 21.

As shown in FIG. 18, the positive and negative brushes 32*a*, 32*b*, the brush springs 31*a*, 31*b* and the positive and negative brush terminals 34*a*, 34*b* are arranged in this order from a lower side to an upper side, and are installed in the pipe portions 52*a*, 52*b* (see FIGS. 2A, 2B). The positive and negative brushes 32*a*, 32*b* are installed in the pipe portions 52*a*, 52*b*, respectively, in such a manner that the positive and negative brushes 32*a*, 32*b* are axially slidable. The positive and negative brush terminals 34*a*, 34*b* are fixed to the bearing holder 50*a* by being press-fitted into inner circumferential walls 52*c*, 52*d* of the pipe portions 52*a*, 52*b* in a state that the connecting wires 33*a*, 33*b* are connected with the positive and negative brush terminals 34*a*, 34*b*. Top portions of the positive and negative brush terminals 34*a*, 34*b* protrude out of openings 52*e*, 52*f* of the pipe portions 52*a*, 52*b* so that the positive and negative brush terminals 34*a*, 34*b* can be press-fitted into hole portions 825*a*, 835*a* of relay terminal portions 824*a*, 834*a*.

Although not shown in FIGS. 17, 18, the inner circumferential walls 52*c*, 52*d* of the pipe portions 52*a*, 52*b* have such protrusions 53, 53 as shown in FIG. 13A, which protrude radially inward in the pipe portions 52*a*, 52*b*. Thereby, press-fitting forces for press-fitting the positive and negative brush terminals 34*a*, 34*b* into the inner circumferential walls 52*d*, 52*d* of the pipe portions 52*a*, 52*b* are decreased.

The positive and negative brush terminals 34*a*, 34*b* are fixed on the inner circumferential walls 52*c*, 52*d* of the pipe portions 52*a*, 52*b*, so that the positive and negative brush terminals 34*a*, 34*b* can be easily inserted into the hole portions 825*a*, 835*a* of the relay terminal portions 824*a*, 834*a*.

In this embodiment, the positive and negative brush terminals 34*a*, 34*b* is fixed to the pipe portions 52*a*, 52*b* by press-fitting; however, the method for fixing the positive and negative brush terminals 34*a*, 34*b* to the pipe portions 52*a*, 52*b* is not limited to press-fitting. For example, it is also possible to fix the positive and negative brush terminals 34*a*, 34*b* to the pipe portions 52*a*, 52*b* by insert molding, by adhesive, etc.

The brush spring 31*a* is arranged between the positive brush terminal 34*a* and the positive brush 32*a*, and the brush springs 31*b* is arranged between the negative brush terminal 34*b* and the negative brush 32*b*. The brush springs 31*a*, 31*b* urge the positive and negative brushes 32*a*, 32*b* away from the positive and negative brush terminals 34*a*, 34*b*, respectively. As described above, the positive and negative brush terminals 34*a*, 34*b* are fixed to the pipe portions 52*a*, 52*b*, so that the positive and negative brushes 32*a*, 32*b* can be urged against the commutator 24 by urging forces of the brush springs 31*a*, 31*b*.

The molded body 70*b* has a resin portion 73 and an assembled body 80*b* that includes a positive terminal 82*a*, a negative terminal 83*a*, the relay terminal portions 824*a*, 834*a* and choke coils 84*a*, 84*b*. Constructions and arrangements of the positive and negative terminals 82*a*, 83*a*, the relay terminal portions 824*a*, 834*a* and the choke coils 84*a*, 84*b* in the third embodiment is substantially as same as those of the parts shown in FIGS. 16A-16C, and are not further described hereafter. The resin portion 73 is formed to cover the assembled body 80*b*. The assembled body 80*b* is embedded in the resin portion 73 by insert molding.

As shown in FIGS. 17, 18, the resin portion 73 has a connector portion 74 and partition portions. The connector portion 74 is formed to surround power receiving portions 821*a*, 831*a* of the positive and negative terminals 82*a*, 83*a* so that the connector portion 74 can be connected with a power supply connector (not shown).

As shown in FIG. 18, the partition portions 75*a*, 75*b* cover peripheries of the hole portions 825*a*, 835*a* of the relay terminal portions 824*a*, 834*a*, respectively. The partition portions 75*a*, 75*b* have contact portions 76*a*, 76*b* and lid portions 77*a*, 77*b*. The contact portions 76*a*, 76*b* contact end portions of the pipe portions 52*a*, 52*b*. The lid portions 77*a*, 77*b* lid upper portions of the contact portions 76*a*, 76*b*, which are opposite from lower portions of the contact portions 76*a*, 76*b* that contact the end portions of the pipe portions 52*a*, 52*b*.

The positive and negative brush terminals 34*a*, 34*b*, the brush springs 31*a*, 31*b*, the connecting wires 33*a*, 33*b* and the positive and negative brushes 32*a*, 32*b* are installed in the pipe portions 52*a*, 52*b*. Then, the positive and negative brush terminals 34*a*, 34*b* are press-fitted to the hole portions 825*a*, 835*a* of the relay terminal portions 824*a*, 834*a*, respectively. Thereby, the partition portions 75*a*, 75*b* are attached to the pipe portions 52*a*, 52*b*. In a state where the partition portions 75*a*, 75*b* are attached to the pipe portions 52*a*, 52*b*, the contact portions 76*a*, 76*b* are in contact with the end portions of the pipe portions 52*a*, 52*b*. In this manner, the spaces in which the hole portions 825*a*, 835*a* of the relay terminal portions 824*a*, 834*a* are connected with the positive and negative brush terminals 34*a*, 34*b* are partitioned from an outside of the pipe portions 52*a*, 52*b*, by attaching the partition portions 75*a*, 75*b* to the pipe portions 52*a*, 52*b*.

As in the case of the second embodiment, the hole portions 825*a*, 835*a* of this embodiment have protrusions 827*a*, 837*a* shown in FIG. 16C. Thereby, press-fitting forces for press-fitting the positive and negative brush terminals 34*a*, 34*b* into the hole portions 825*a*, 835*a* are decreased.

By attaching the partition portions 75*a*, 75*b* to the pipe portions 52*a*, 52*b*, it is possible to prevent the fuel, which flows around the pipe portions 52*a*, 52*b*, from entering into the spaces in which the relay terminal portions 824*a*, 834*a* are connected with the positive and negative brush terminals 34*a*, 34*b*. Then, positive terminal parts such as the relay terminal portion 824*a* and the positive brush terminal 34*a* are isolated from negative terminal parts such as the relay terminal portion 834*a* and the negative brush terminal 34*b*. Therefore, it is possible to inhibit current leakage between the positive terminal parts and the negative terminal parts. Even if fuel inflow into the spaces in which the relay terminal portions 824*a*, 834*a* are connected with the positive and negative brush terminals 34*a*, 34*b* cannot be perfectly prevented, an amount of the fuel inflow can be reduced by the construction in which the partition portions 75*a*, 75*b* are attached to the pipe portions 52*a*, 52*b*. Therefore, electric resistance between the positive terminal parts and negative terminal parts can be increased and the current leakage is restricted. Accordingly, even if the fuel is an alternative fuel that contains electrically conductive ingredients, it is possible to inhibit electric corrosion of the terminal parts, poor electrical continuity at the terminal parts and breakage of the terminal parts.

In this embodiment, the partition portions 75*a*, 75*b* are attached to the positive pole-side pipe portion 52*a* and to the negative pole-side pipe portion 52*b*, respectively. Alternatively, it is also possible to attach either one of the partition portions 75*a*, 75*b* to corresponding one of the pipe portions 52*a*, 52*b*. It is possible to inhibit current leakage between the positive terminal parts and the negative terminal parts just by preventing the fuel from entering into either one of the above-mentioned spaces, in which the relay terminal portions 824*a*, 834*a* are connected with the positive and negative brush terminals 34*a*, 34*b*, by attaching either one of the partition portions 75*a*, 75*b* to the corresponding one of the pipe portions 52*a*, 52*b*.

According to this embodiment, the bearing holder 50*a* has the discharge port 623*a*, so that the discharge-side cover 60, which the fuel pump 10 according to the first and second embodiments can be eliminated. Accordingly, it is possible to decrease the number of parts of the fuel pump 10*a*.

According to this embodiment, it is possible to partition the above-mentioned spaces, in which the hole portions 825*a*, 835*a* of the relay terminal portions 824*a*, 834*a* are connected with the positive and negative brush terminals 34*a*, 34*b*, from the outside of the pipe portions 52*a*, 52*b*, by a simple construction in which the partition portions 75*a*, 75*b* cover the positive and negative brush terminals 34*a*, 34*b* side openings 52*e*, 52*f* of the cylindrically-shaped pipe portions 52*a*, 52*b*.

The contact portions 76*a*, 76*b* has a construction to cover the peripheries of the hole portions 825*a*, 835*a* and to contact the end portion of the pipe portions 52*a*, 52*b*. In addition, the partition portions 75*a*, 75*b* has the lid portions 77*a*, 77*b* that lid the upper portions of the contact portions 76*a*, 76*b*, which are opposite from the lower portions of the contact portions 76*a*, 76*b* that contact the end portions of the pipe portions 52*a*, 52*b*. Thereby, in the state where the partition portions 75*a*, 75*b* are attached to the pipe portions 52*a*, 52*b*, a fuel entry path into the above-mentioned spaces, in which the hole portions 825*a*, 835*a* of the relay terminal portions 824*a*, 834*a* are connected with the positive and negative brush terminals 34*a*, 34*b*, is limited to a part in which the contact portions 76*a*, 76*b* contact the end portions of the pipe portions 52*a*, 52*b*. That is, the fuel entry path is limited to one.

By this construction, it is possible to decrease the fuel entry path into the above-mentioned spaces, in which the hole portions 825*a*, 835*a* of the relay terminal portions 824*a*, 834*a* are connected with the positive and negative brush terminals 34*a*, 34*b*, with respect to a construction in which the peripheries of the hole portions 825*a*, 835*a* are not covered by the contact portions 76*a*, 76*b* and the hole portions 825*a*, 835*a* are clamped between the partition portions 75*a*, 75*b* and the pipe portions 52*a*, 52*b* to prevent the fuel from entering into the above-mentioned spaces. Thereby, it is possible to inhibit electric corrosion of the terminal parts more effectively.

In this embodiment, the protrusions 53, 53 are formed on the pipe portions 52*a*, 52*b*, and tips of the protrusions 53, 53 are deformed flat when the positive and negative brush terminals 34*a*, 34*b* are press-fitted into the pipe portions 52*a*, 52*b*. Thereby, press-fitting forces for press-fitting the positive and negative brush terminals 34*a*, 34*b* into the pipe portions 52*a*, 52*b* are decreased, and outer circumferential walls of the pipe portions 52*a*, 52*b* are destressed. Accordingly, it is possible to inhibit generation of cracks on the pipe portions 52*a*, 52*b* and to inhibit electric corrosion that is caused by fuel entering through the cracks.

In this embodiment, the protrusions 827*a*, 837*a* are formed on the hole portions 825*a*, 835*a*, and tips of the protrusions 827*a*, 837*a* are deformed flat when the positive and negative brush terminals 34*a*, 34*b* are press-fitted into the hole portions 825*a*, 835*a*. Thereby, press-fitting forces for press-fitting the positive and negative brush terminals 34*a*, 34*b* into the hole portions 825*a*, 835*a* are decreased, and the contact portions 76*a*, 76*b* are destressed. Accordingly, it is possible to inhibit generation of cracks on the contact portions 76*a*, 76*b* and to inhibit electric corrosion that is caused by fuel entering through the cracks.

The pipe portions 52*a*, 52*b* in this embodiment correspond to an installation portion in the appended claims. The resin portion 73 in this embodiment corresponds to a isolation member in the appended claims.

Additional advantages and modifications will readily occur to those skilled in the art. The invention in its broader terms is therefore not limited to the specific details, representative apparatus, and illustrative examples shown and described.

What is claimed is:

1. A fuel pump comprising:

a discharge-side cover that has a fuel discharge port;

a case member that has a fuel suction port and is connected with the discharge-side cover, wherein the case member has a fuel passage provided therein for communication between the fuel suction port and the fuel discharge port;

a pump portion that is placed in the fuel passage to suck fuel from the fuel suction port and to pump the fuel to the fuel discharge port;

a motor portion that is placed in the case member to drive the pump portion;

a positive terminal and a negative terminal that extend from an inside of the discharge-side cover to an outside of the discharge-side cover to receive the electricity for driving the motor portion from an external electric power source;

a holder that is disposed inside the discharge-side cover and that holds a positive brush and a negative brush to slide on a commutator of the motor portion to conduct the electricity from the positive and negative terminals to the motor portion;

a positive brush terminal and a negative brush terminal that are held by the holder and that are respectively placed between the positive terminal and the positive brush and between the negative terminal and the negative brush to conduct the electricity between the positive terminal and the positive brush and between the negative terminal and the negative brush, wherein:

the positive terminal has a positive connector portion that is connected with the positive brush terminal;

the negative terminal has a negative connector portion that is connected with the negative brush terminal; and at least one of the positive and negative connector portions, with circumference of one connector portion isolated from the other connector portion, is clamped by an inner wall of the discharge-side cover and an outer wall of the holder facing thereto.

2. The fuel pump according to claim 1, wherein:

the positive connector portion has a hole portion into which the positive brush terminal is press-fitted;

the negative connector portion has a hole portion into which the negative brush terminal is press-fitted;

the at least one of the positive and negative connector portions is covered with a resin covering except the hole portion; and the inner wall of the discharge-side cover and the outer wall of the holder clamp the resin covering therebetween.

3. The fuel pump according to claim 2, wherein:

the resin covering around the hole portion is formed by filling a melted resin in a mold, and the resin covering has a through hole that penetrates through the hole portion of the at least one of the positive and negative connector portions.

4. The fuel pump according to claim 2, wherein a plurality of protrusions are formed on an inner circumferential surface of each of the hole portions.

5. The fuel pump according to claim 1, wherein:

the positive connector portion has a hole portion into which the positive brush terminal is press-fitted;

the negative connector portion has a hole portion into which the negative brush terminal is press-fitted;

the outer wall of the holder has holder-side cylinder portions that respectively extend toward the inner wall of the discharge-side cover, wherein the holder-side cylinder portions respectively accommodate the positive brush terminal and the negative brush terminal contained therein and respectively hold the positive brush and the negative brush slidably in an axial direction;

the inner wall of the discharge-side cover has cover-side cylinder portions that respectively extend to an end portion of the holder-side cylinder portions; and the cover-side cylinder portions and the holder-side cylinder portions circumferentially clamp the positive and negative connector portions.

6. The fuel pump according to claim 5, wherein the brush terminals are formed in a cylinder shape and are fixed to the inner wall of the holder-side cylinder portions.

7. The fuel pump according to claim 5, wherein:

the positive and negative brush terminals are formed in a cylinder shape and are fixed in a press-fitted manner into the holder-side cylinder portions; and a plurality of protrusions are formed on an inner circumferential surface of each of the holder-side cylinder portions, into which the brush terminals are press-fitted.

8. The fuel pump according to claim 1, wherein:

the discharge-side cover and the holder leave a clearance therebetween in an axial direction in which a relative movement between the discharge-side cover and the holder is limited in an assembled state where the wall of the discharge-side cover and the wall of the holder securely clamp the at least one of the positive and negative connector portions therebetween.

9. A fuel pump comprising:

a discharge-side cover that has a fuel discharge port;

a case member that has a fuel suction port and is connected with the discharge-side cover, wherein the case member has a fuel passage provided therein for communication between the fuel suction port and the fuel discharge port;

a pump portion that is placed in the fuel passage to suck fuel from the fuel suction port and to pump the fuel to the fuel discharge port;

a motor portion that is placed in the case member to drive the pump portion;

a positive terminal and a negative terminal that extend from an inside of the discharge-side cover to an outside of the discharge-side cover to receive the electricity for driving the motor portion from an external electric power source;

a holder that is disposed inside the discharge-side cover and that holds a positive brush and a negative brush to slide on a commutator of the motor portion to conduct the electricity from the positive and negative terminals to the motor portion;

a positive brush terminal and a negative brush terminal that are held by the holder and that are respectively placed between the positive terminal and the positive brush and between the negative terminal and the negative brush to conduct the electricity from the positive terminal to the positive brush and from the negative terminal to the negative brush, wherein:

a positive brush terminal side end portion of the positive terminal has a hole portion into which the positive brush terminal is press-fitted;

a negative brush terminal side end portion of the negative terminal has a hole portion into which the negative brush terminal is press-fitted;

the positive brush terminal side end portion of the positive terminal and the negative brush terminal side end portion of the negative terminal are covered with a resin covering except the hole portions, the resin covering around the hole portions being formed by filling a melted resin in a mold; and the resin covering has through holes that penetrate through the hole portions.

10. The fuel pump according to claim 9, wherein the resin covering is clamped by an inner wall of the discharge-side cover and an outer wall of the holder facing thereto.

11. The fuel pump according to claim 9, wherein a plurality of protrusions are formed on an inner circumferential surface of each of the hole portions.

12. The fuel pump according to claim 9, wherein:

an outer wall of the holder has holder-side cylinder portions that respectively extend toward the inner wall of the discharge-side cover, wherein the holder-side cylinder portions respectively accommodate the positive brush terminal and the negative brush terminal contained therein and respectively hold the positive brush and the negative brush slidably in an axial direction;

an inner wall of the discharge-side cover has cover-side cylinder portions that respectively extend to an end portion of the holder-side cylinder portions; and the resin covering is clamped by the holder-side cylinder portions and the cover-side cylinder portions.

13. The fuel pump according to claim 12, wherein both of the positive and negative brush terminals are formed in a cylinder shape and are fixed to an inner wall of the holder-side cylinder portions.

14. The fuel pump according to claim 12, wherein:

both of the positive and negative brush terminals are formed in a cylinder shape and are fixed in a press-fitted manner into the holder-side cylinder portions; and a plurality of protrusions are formed on an inner wall of each of the holder-side cylinder portions.

15. The fuel pump according to claim 9, wherein the discharge-side cover and the holder leave a clearance therebetween in an axial direction in which a relative movement between the discharge-side cover and the holder is limited in an assembled state where the wall of the discharge-side cover and the wall of the holder securely clamp the at least one of the positive and negative connector portions therebetween.

16. A fuel pump disposed in a fuel tank to pump fuel from an inside to an outside of the tank, the fuel pump comprising:

a case member that defines a fuel passage therein and has a fuel suction port that communicates with the fuel passage to suck fuel into the fuel passage;

a pump portion that is placed in the fuel passage to pump fuel from the fuel suction port to an exit side of the fuel passage;

a motor portion that is placed in the case member to drive the pump portion;

a positive brush and a negative brush that conduct the electricity from outside to the motor portion;

a positive brush terminal and a negative brush terminal that conduct the electricity to the positive brush and negative brush;

a positive terminal and a negative terminal that conduct the electricity to the positive brush and the negative brush; and a holder that is fixed to the case member, wherein:

the positive terminal has a positive connector portion that is connected with the positive brush terminal to supply electrical power from an exterior to the positive brush terminal;

the negative terminal has a negative connector portion that is connected with the negative brush terminal to supply electrical power from an exterior to the negative brush terminal;

the holder has (i) an installation portion that has the positive brush, the negative brush, the positive brush terminal and the negative brush terminal accommodated therein, and (ii) a discharge hole to discharge fuel from the fuel passage to an outside of the case member; and an isolation member having a partition is attached to the installation portion, by connecting the positive connector portion to the positive brush terminal and connecting the negative connector portion to the negative brush terminal, to partition at least one of (i) an installation space in which the positive connector portion is connected with the positive brush terminal and (ii) an installation space in which the negative connector portion is connected with the negative brush terminal, from an outside of the installation portion.

17. The fuel pump according to claim 16, wherein:

the positive connector portion has a hole portion into which the positive brush terminal is press-fitted;

the negative connector portion has a hole portion into which the negative brush terminal is press-fitted;

the partition covers at least one of the positive and negative connector portions except the hole portion and has (i) an abutment portion that is abutted to the installation portion and (ii) a cap portion that caps an opposite portion of the partition that is opposite to the abutment portion.

18. The fuel pump according to claim 17, wherein a plurality of protrusions are formed on an inner circumferential surface of each of the hole portions.

19. The fuel pump according to claim 16, wherein:

the positive connector portion has a hole portion into which the positive brush terminal is press-fitted;

the negative connector portion has a hole portion into which the negative brush terminal is press-fitted;

the installation portion has a cylinder shape to accommodate the positive brush terminal and the negative brush terminal and to slidably hold the positive brush and the negative brush in an axial direction;

the partition is attached to the installation portion to cover at least one of openings of the installation portion on a positive brush side and on a negative brush side together with covering the hole portion.

20. The fuel pump according to claim 19, wherein the positive and negative brush terminals are formed in a cylinder shape, and are fixed to an inner circumferential wall of the installation portion.

21. The fuel pump according to claim 19, wherein:

the positive and negative brush terminals are formed in a cylinder shape, and are fixed in a press-fitted manner into an inner circumferential surface of the installation portion; and a plurality of protrusions are formed on a portion of the inner circumferential surface of the installation portion into which the positive and negative brush terminals are press-fitted.

* * * * *